US011571031B2

(12) United States Patent
Motadel et al.

(10) Patent No.: US 11,571,031 B2
(45) Date of Patent: Feb. 7, 2023

(54) FACE SHIELD

(71) Applicant: Xcaliber Sciences, Inc., San Diego, CA (US)

(72) Inventors: Arta Motadel, San Diego, CA (US); Scott Curry, San Diego, CA (US)

(73) Assignee: XCALIBER SCIENCES, INC., San Diego, CA (US)

( * ) Notice: Subject to any disclaimer, the term of this patent is extended or adjusted under 35 U.S.C. 154(b) by 0 days.

(21) Appl. No.: 17/599,442

(22) PCT Filed: Apr. 21, 2021

(86) PCT No.: PCT/US2021/028284

§ 371 (c)(1),
(2) Date: Mar. 30, 2022

(87) PCT Pub. No.: WO2021/247158

PCT Pub. Date: Dec. 9, 2021

(65) Prior Publication Data

US 2022/0264970 A1 Aug. 25, 2022

Related U.S. Application Data

(63) Continuation of application No. 16/935,463, filed on Jul. 22, 2020, now abandoned.

(60) Provisional application No. 63/040,635, filed on Jun. 18, 2020, provisional application No. 63/037,787, filed on Jun. 11, 2020, provisional application No. 63/035,703, filed on Jun. 6, 2020, provisional application No. 63/033,655, filed on Jun. 2, 2020.

(51) Int. Cl.
*A41D 13/11* (2006.01)

(52) U.S. Cl.
CPC ..... *A41D 13/1161* (2013.01); *A41D 13/1107* (2013.01)

(58) Field of Classification Search
CPC ..... A41D 13/1161; A41D 13/1107; A41D 13/1184
See application file for complete search history.

(56) References Cited

U.S. PATENT DOCUMENTS 2,988,743 A 6/1961 Wagenfeld
3,789,428 A 2/1974 Martin
4,317,238 A 3/1982 Amin
(Continued)

FOREIGN PATENT DOCUMENTS

ES 1247600 4/2020

*Primary Examiner* — Katherine M Moran
(74) *Attorney, Agent, or Firm* — Manuel de la Cerra

(57) ABSTRACT

A face shield for covering the eyes, nose and mouth of a user is disclosed. The face shield includes a face shield body that has a transparent surface having a first side edge, a second side edge, and a top edge. The first and second side edges include a first and a second anchor/barb, respectively, both of which define a line. A spacer is attached at or near the line, and the spacer extends away from the face shield body. An elastic strap with a first slot and a second slot receives the first and second anchor/barbs. When the user wears the face shield, the elastic strap is in a stretched configuration that pulls on the first and second anchor/barbs, and in this configuration the first slot is detachably affixed to the first anchor/barb, and the second slot is detachably affixed to the second anchor/barb.

12 Claims, 30 Drawing Sheets

(56) References Cited

U.S. PATENT DOCUMENTS

| | | | | |
|---|---|---|---|---|
| 4,852,185 | A | 8/1989 | Olson | |
| 4,852,186 | A | 8/1989 | Landis | |
| 4,864,653 | A | 9/1989 | Landis | |
| 4,868,930 | A | 9/1989 | Blackstone | |
| 4,944,312 | A | 7/1990 | Smith | |
| 5,012,527 | A | 5/1991 | Michel | |
| 5,440,760 | A * | 8/1995 | Highsmith | A41D 13/11 128/857 |
| 5,469,229 | A | 11/1995 | Greenbaum | |
| 5,720,052 | A | 2/1998 | Walker | |
| 5,732,410 | A | 3/1998 | Machson | |
| 5,765,223 | A | 6/1998 | McCausland | |
| 5,794,276 | A | 8/1998 | Walker | |
| 5,983,390 | A * | 11/1999 | Desy | A41D 13/1161 2/9 |
| 9,532,617 | B2 * | 1/2017 | Miller | A41D 13/1184 |
| 10,455,871 | B2 * | 10/2019 | Pearce | A41D 13/1107 |
| D899,002 | S * | 10/2020 | Chapman | A41D 13/1184 D29/110 |
| D910,241 | S | 2/2021 | Koefelda | |
| 2004/0118405 | A1 | 6/2004 | Amante | |
| 2007/0048358 | A1 | 3/2007 | Schorr | |
| 2015/0173953 | A1 | 6/2015 | Wang | |
| 2015/0237931 | A1 * | 8/2015 | Miller | A41D 13/1184 2/9 |
| 2016/0058080 | A1 * | 3/2016 | Pearce | A41D 13/1184 128/206.12 |
| 2016/0353815 | A1 | 12/2016 | Nabai | |
| 2021/0346204 | A1 * | 11/2021 | Goldberg | A61F 9/029 |

* cited by examiner (Detail A From FIG. 3A)

(Detail A From FIG. 4A)

(Detail A From FIG. 5A)

(Detail A From FIG. 6A)

(Detail A from FIG. 10B)

(Detail A From FIG. 12B)

FACE SHIELD

1.0 RELATED APPLICATIONS

This application claims priority as the PCT of U.S. patent Ser. No. 16/935,463 title "Face Shield", filed on Jul. 22, 2020, which claims priority to U.S. Patent Ser. No. 63/033,655 titled "Face Shield", filed on Jun. 2, 2020, to U.S. Patent Ser. No. 63/035,703 titled "Face Shield", filed on Jun. 6, 2020, to U.S. Patent Ser. No. 63/037,787 titled "Face Shield", filed on Jun. 11, 2020, and to U.S. Patent Ser. No. 63/040,635 titled "Face Shield", filed on Jun. 18, 2020. The entire contents of these applications are incorporated herein by reference.

2.0 FIELD OF THE INVENTION

This invention relates to personal protective equipment, and more particularly to face shields.

3.0 BACKGROUND

Health experts have long known about the dangers of respiratory illnesses and respiratory occupational hazards such as coal dust and fine particulate matter in quarries and mills. Personal protective equipment such as masks and face shields have been around for decades, but have not been widely used until more recently. The recent pandemic of COVID-19 has increased the importance of fit and function in personal protective equipment, and the increased demand for personal protective equipment in all occupations exacerbates the need for improved designs.

U.S. Pat. No. 5,440,760 granted to Highsmith teaches a face shield to be worn using just a cord. There is no further elaboration on the method of securing the face shield to the user's head, other than the mention of a cord element. U.S. Pat. No. 9,949,517 granted to Howard incorporates a "flexible, stretchable headband" and a viewing window, constructed of a transparent material surrounded by translucent material, that is intended to focus the user's vision onto the transparent viewing window area. In both these prior art embodiments, there is lacking accurate consideration of how the cord or stretchable headband attaches to the face shield, and there is no accounting for and correcting for the visual distortion users would experience, as a result of the curvature of the face shield constructed of a continuous sheet of material. The face shields of the prior art are not suited for long use and improved visibility. There is additionally no consideration in the prior art inventions for auditory distortions resulting from the face shield being pressed and wrapped around the user's ears.

It would be advantageous, therefore, to address and solve these shortcomings of the prior art.

4.0 SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The apparatus, systems, and methods described herein elegantly solve the problems presented above. A face shield for covering the eyes, nose and mouth of a user is disclosed.

The face shield includes a face shield body that has a transparent surface with a first side edge, a second side edge and a top edge. The first and second side edges include a first and second anchor/barb, respectively, both of which define a line. A spacer is attached at or near the line, and the spacer extends away from the face shield body. An elastic strap with a first slot and a second slot receives the first and second anchor/barbs. When the user wears the face shield, the elastic strap is in a stretched configuration that pulls on the first and second anchor/barbs, and in this configuration, the first slot is detachably affixed to the first anchor/barb, and the second slot is detachably affixed to the second anchor/barb.

The anchor/barb may include a necked region and a flared region, wherein the stretched configuration of the slot surrounds the necked region and abuts the flared region, and the flared region prevents the slot from fully detaching from the first anchor/barb.

The transparent surface may be made of an anti-fog material, and/or an anti-viral material. It may be tinted, UV-filtering and anti-static. The transparent surface may include a magnification region. When the user wears the face shield, the transparent surface may be curved, and the magnification area may further include a plurality of magnification areas whose magnification is based on the transparent surface curvature. The transparent surface may be constructed to cover the user's ear, and it may have a plurality of hearing slots positioned adjacent to the user's ears. The transparent surface may include a bulk region and an integrated spacer region that includes the spacer. A fold line can separate the bulk region from the integrated spacer region, and the fold line may run along the top edge.

The face shield may include a cloth-like edge material attached to and extending away from the first and second edges of the transparent surface. The cloth-like edge material may be electrostatically charged, may be an absorbent wicking material and/or made of a polyester blend. The cloth-like edge material may be attached to the first and second edges by adhesive, fastener, stitching and/or thermal welding.

The spacer may be comprised of compressible foam, polyurethane foam and/or anti-microbial foam. The spacer may be integrated with the face shield body and therefore is comprised of transparent sheet itself.

The elastic strap may include a first end and a second end, wherein the first strap slot is adjacent to the first end, and the second strap slot is adjacent to the second end. The elastic strap may further include a plurality of length adjustment slots.

The first side edge, the second side edge and the top edge define a face shield body frame. The first anchor/barb and second anchor/barb may be within, partially outside or completely outside the face shield body frame. The first anchor/barb may be connected to the transparent surface by an elongate tab, and that tab may extend outside of the face shield frame.

The elongate tab may be continuous with the top edge.

These refinements may be used in alternate embodiments. For example, instead of the transparent surface including the barb/anchor and the elastic strap having the slots, the transparent surface may include the slots and the strap may include the barb/anchor. In this configuration, the slot may be constructed of two slits substantially orthogonal to each other to facilitate inserting the anchor/barb from the elastic strap; otherwise, the elastic strap may be floppy and difficult to secure without the orthogonal slits. As another example, instead of having a separate strap, the transparent surface may have a first elongate tab extending away from the first edge, wherein the first elongate tab includes an anchor/barb with a necked region and a flared region. The transparent surface may also have a second elongate tab extending away from the second edge, wherein the second elongate tab includes a slot constructed to receive the anchor/barb. When the user wears this face shield, the anchor/barb is inserted into the slot such that the slot surrounds the necked region and abuts the flared region, and the flared region prevents the slot from fully detaching from the anchor/barb.

Additional aspects, alternatives and variations, as would be apparent to persons of skill in the art, are also disclosed herein and are specifically contemplated as included as part of the invention. The invention is set forth only in the claims as allowed by the patent office in this or related applications, and the following summary descriptions of certain examples are not in any way to limit, define, or otherwise establish the scope of legal protection.

5.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

6.0 DETAILED DESCRIPTION

Figure 1:
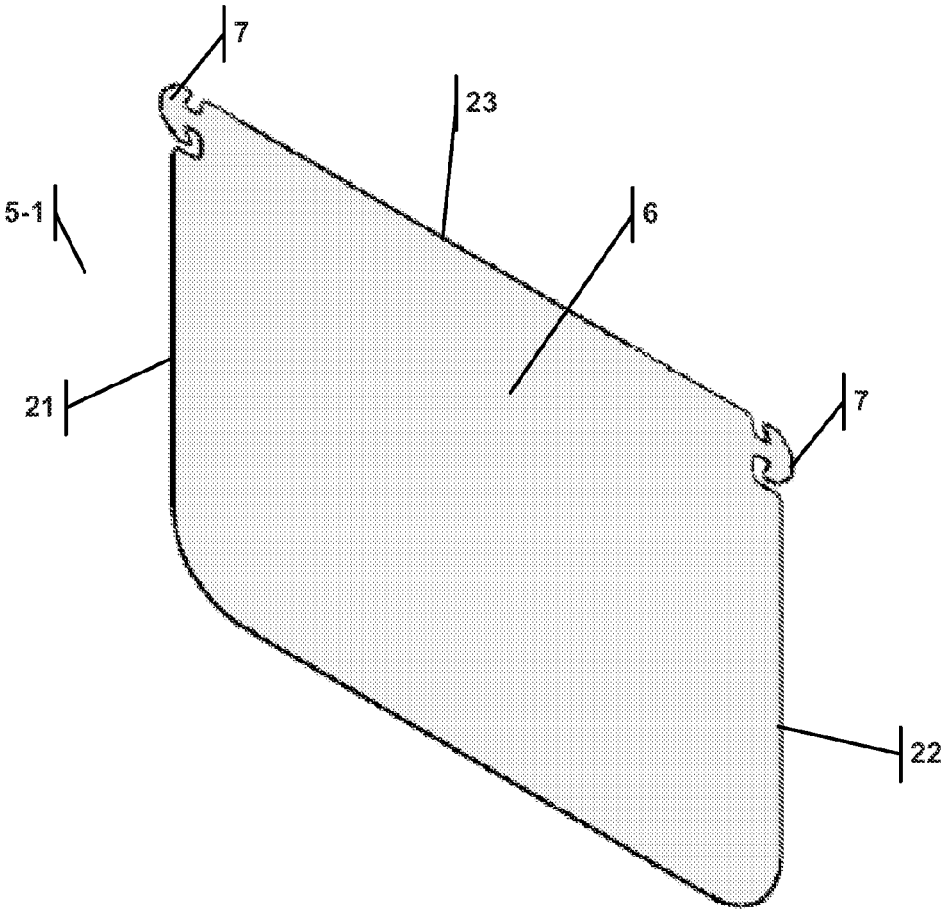
FIG. 1 is an isometric view of a first embodiment of the face shield body with two anchors or barbs on either side of the body, wherein the anchors/barbs are within the frame defined by the body.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated, connection does not necessarily mean a direct, unimpeded connection, unless otherwise noted.

The following list of example features corresponds with the attached figures and is provided for ease of reference, where like reference numerals designate corresponding features throughout the specification and figures:

Face shield body (First Embodiment) 5-1
Face shield body (Second Embodiment) 5-2
Face shield body (Third Embodiment) 5-3
Face shield body (Fourth Embodiment) 5-4
Transparent surface 6
Anchor/barb 7
Anti-fog material 8
Anti-viral material 9
Face shield body frame (First Embodiment) 10-1
Face shield body frame (Second Embodiment) 10-2
Face shield body frame (Third Embodiment) 10-3
Face shield body frame (Fourth Embodiment) 10-4
Magnification region 12
Magnification area one 12-1
Magnification area two 12-2
Magnification area three 12-3
Edge adhesive 13
Cloth-like edge material 14
Extension beyond the frame 15
Elongate tab extending beyond frame 20
Transparent surface first side edge 21
Transparent surface second side edge 22
Transparent surface top edge 23
Line defined by the two anchor/barbs 24
Completed three piece mask 25
Anchor/barb necked region 26
Anchor/barb flared region 27
Foam spacer 30
Slotted Elastic strap 35
Strap first end 36
Strap second end 37
First strap slot 38
Second strap slot 39
Length adjustment slots 40
Face shield body (Fifth Embodiment) 45
First elongate tab extending beyond frame comprising an anchor/barb 50
Second elongate tab extending beyond frame comprising length adjustment slots 55
Bulk region 57
Integrated region 60
Integrated spacer body 65
Integrated spacer barb 70
Fold line separating bulk region from integrated spacer region 72
Fold line/contact point with forehead 75
Barb slot 80
Face shield body (Sixth Embodiment) 85
First face shield slot 86
Second face shield slot 87
First anchor/barb 88
Second anchor/barb 89
Orthogonal strap slot 95
Barbed elastic strap 100
Face shield body (Seventh Embodiment) 105
Hearing slots (Square-Shaped) 110
Hearing slots (X-shaped) 110-1
Hearing slot cloth-like material cover 112
Face shield body frame (Seventh Embodiment) 115
Top edge extension 120
Original top edge 125

Figure 2:
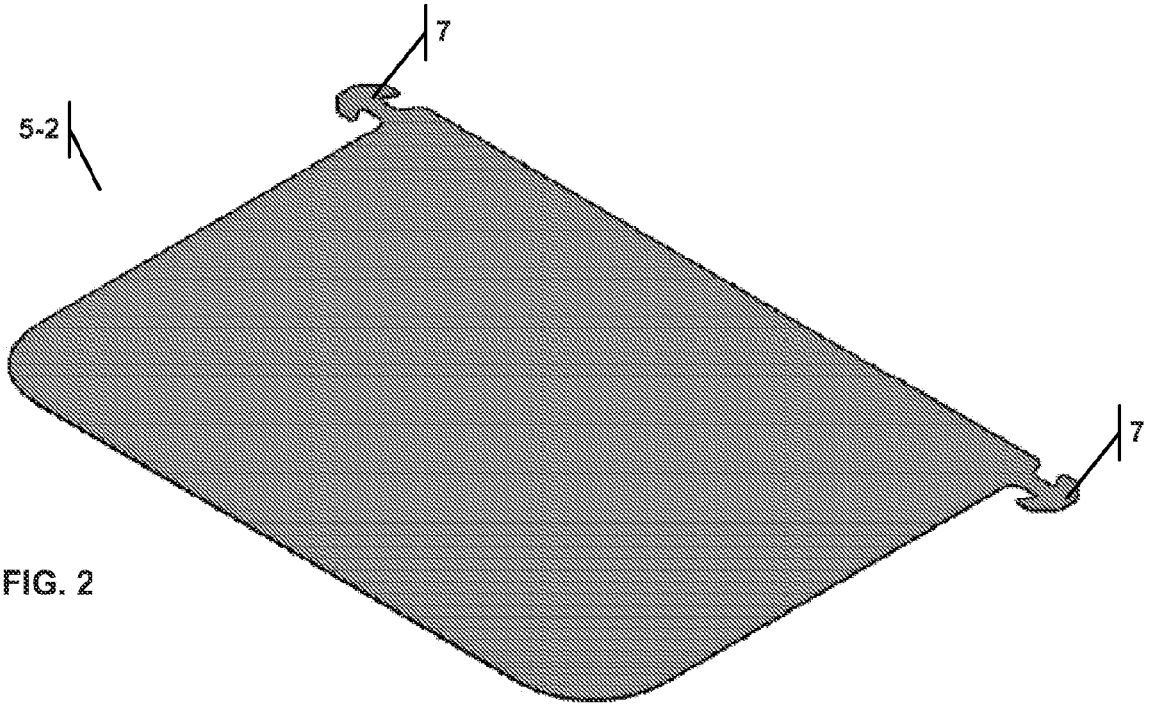
FIG. 2 is an isometric view of a second embodiment of the face shield body with two anchors or barbs on either side of the body, wherein the anchors/barbs extend outside of the frame defined by the body.
Figure 3A:
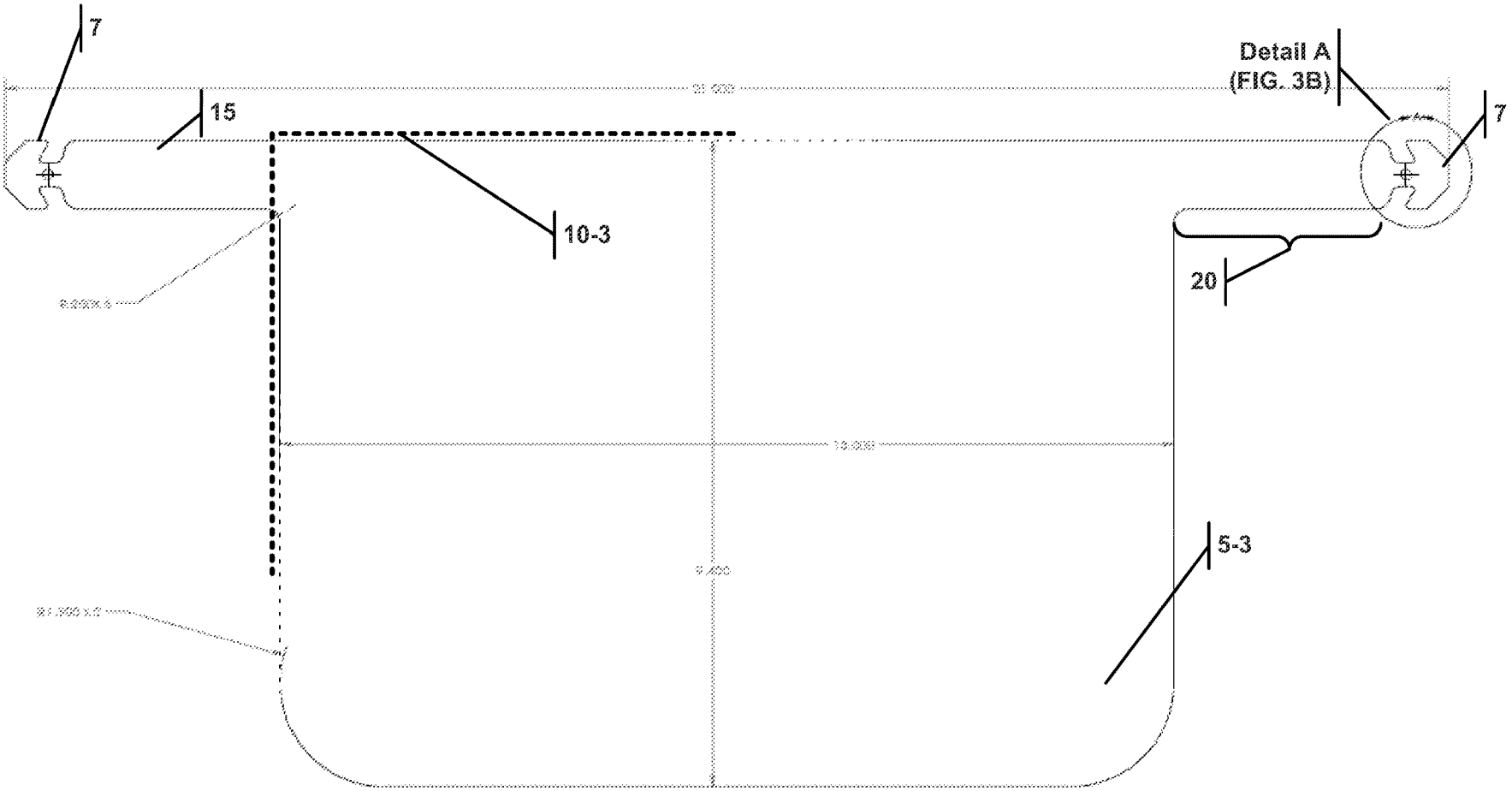
FIG. 3A is an isometric view of a third embodiment of the face shield body with two anchors or barbs on either side of the body, wherein the anchors/barbs extend outside of the frame defined by the body, farther than the anchors/barbs shown in FIG. 2.
Figure 3B:
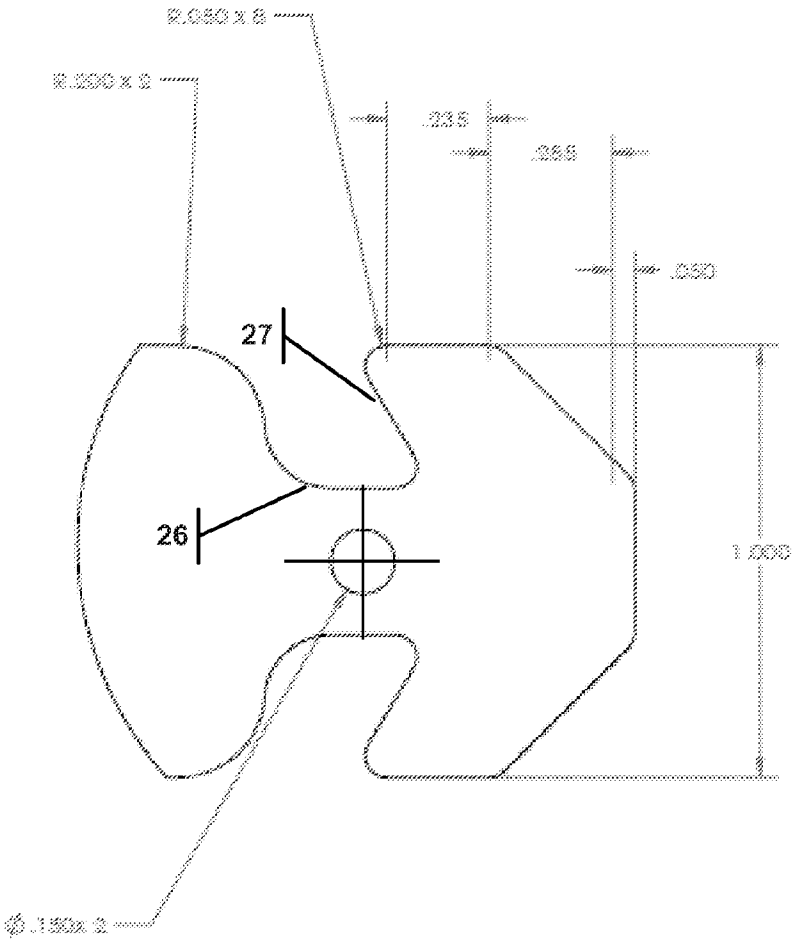
FIG. 3B is an enlargement of Detail A from FIG. 3A, showing the detail of the anchor/barb.
Figure 5A:
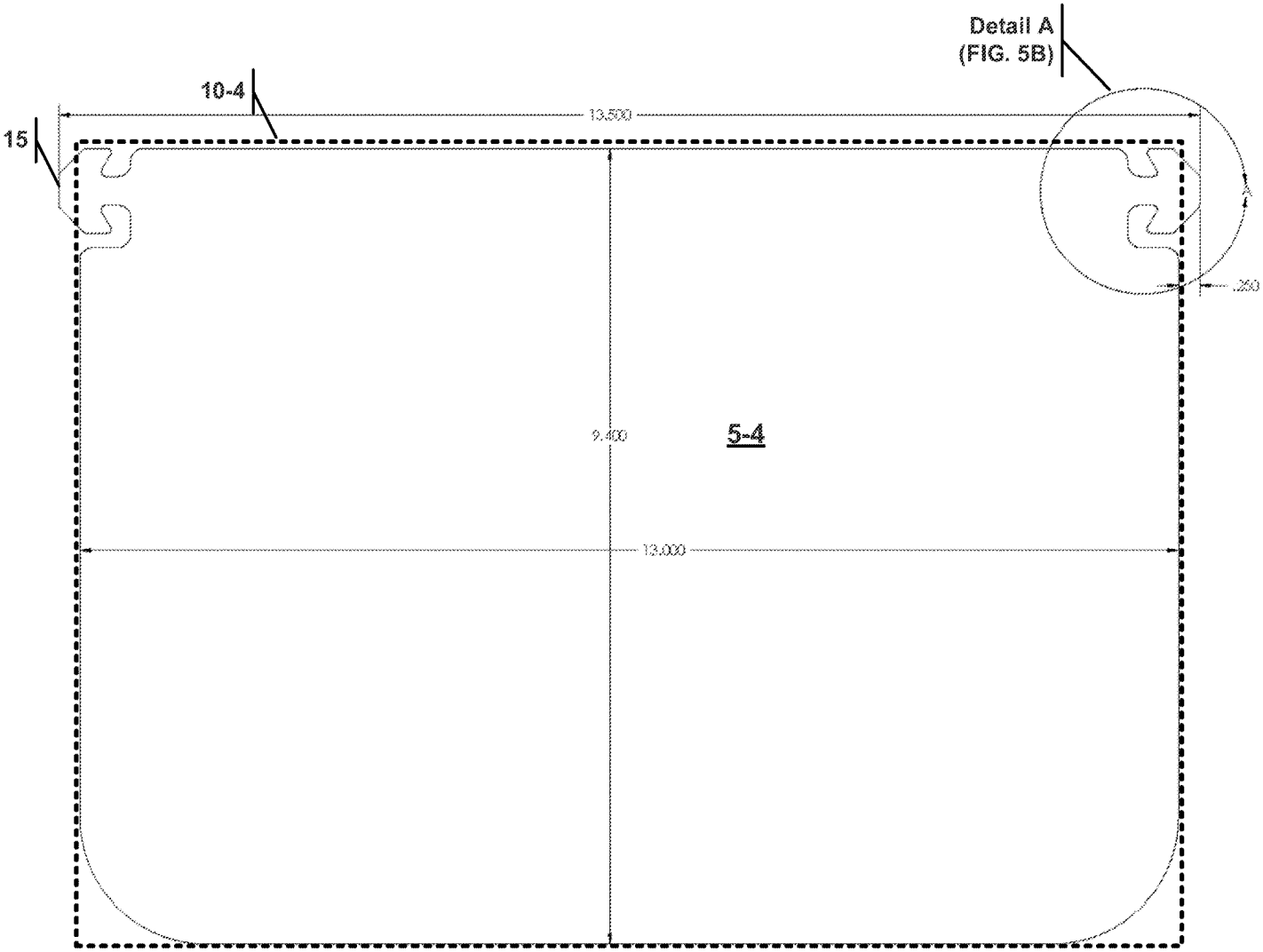
FIG. 5A is a plan view with dimensions of a fourth embodiment of face shield body with two anchors or barbs on either side of the body, wherein the anchors/barbs extend slightly outside of the frame defined by the body.
Figure 5B:
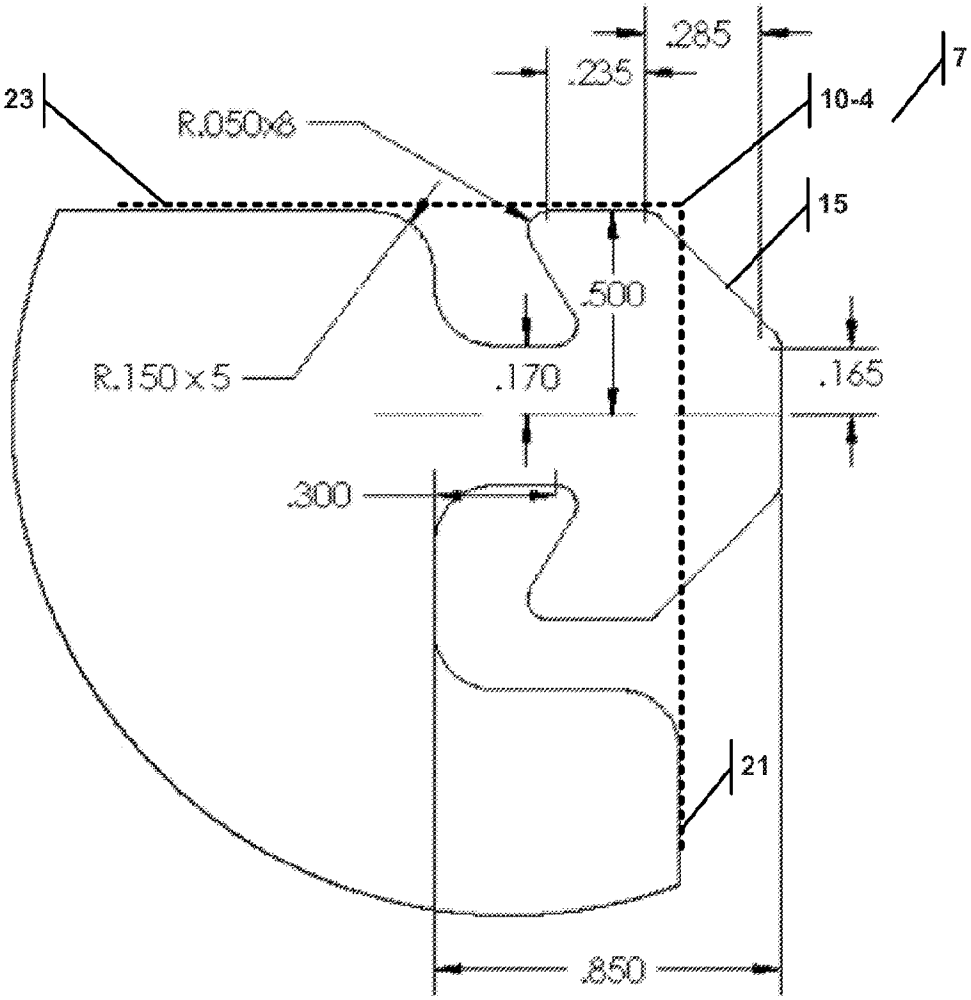
FIG. 5B is an enlargement of Detail A from FIG. 5A showing the detail of the anchor/barb.
Figure 6A:
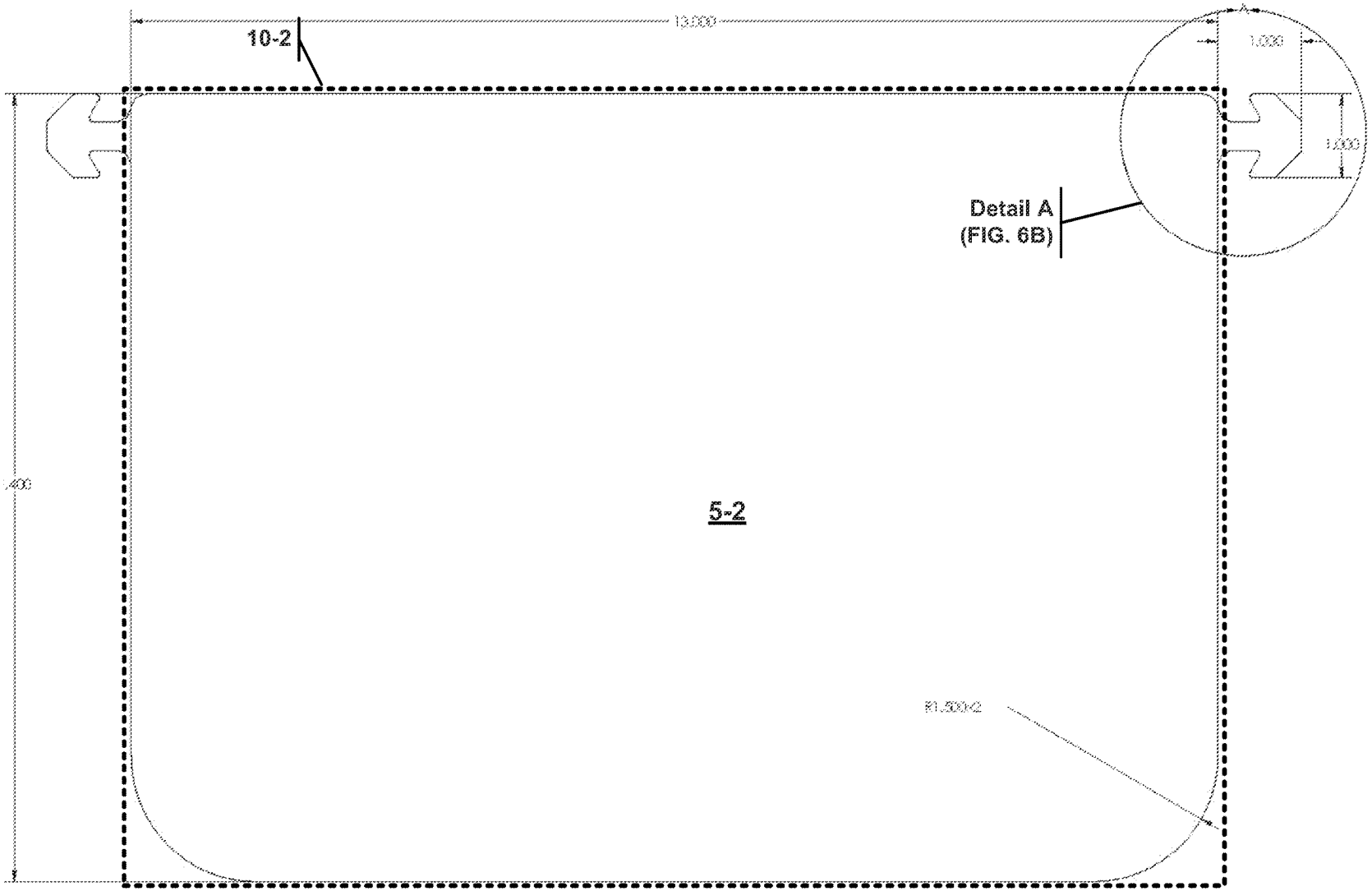
FIG. 6A is a plan view having dimensions of the second embodiment of a face shield body with two anchors or barbs on either side of the body, wherein the anchors/barbs extend outside of the frame defined by the body.
Figure 6B:
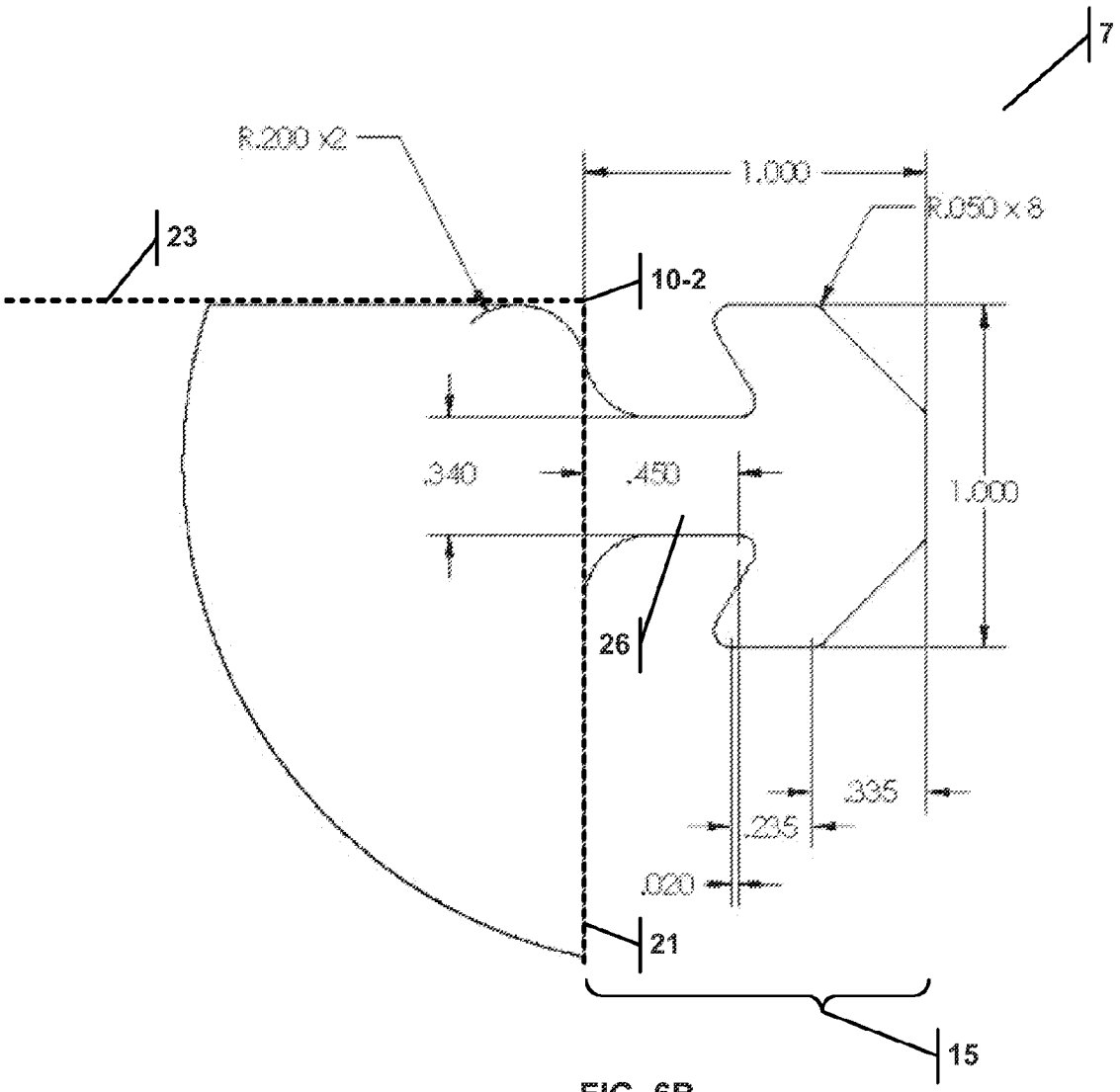
FIG. 6B is an enlargement of Detail A from FIG. 6A showing the detail of the anchor/barb.
Figure 9A:
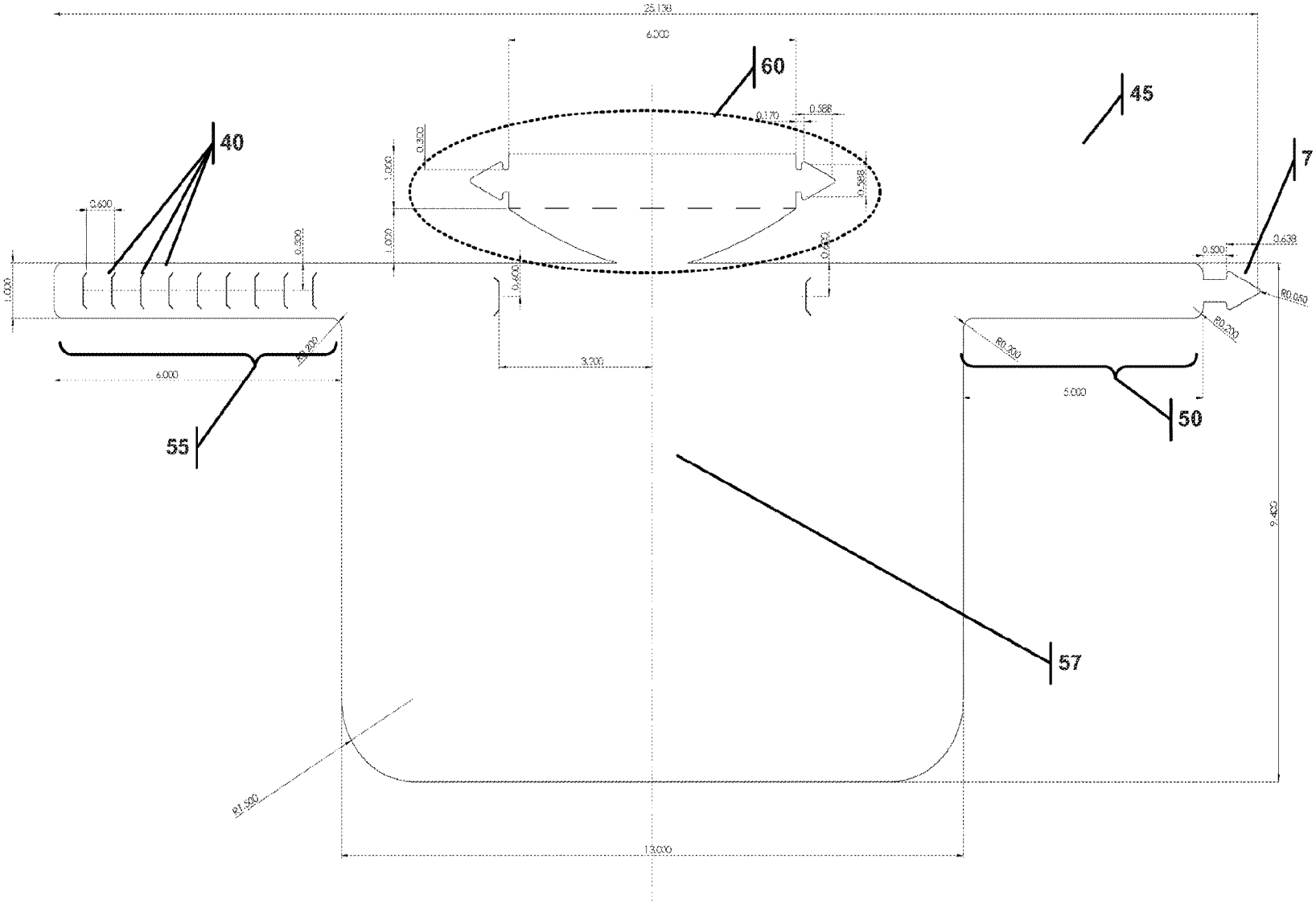
FIG. 9A is a fifth embodiment of a face shield with a one-piece construction. Specifically, this embodiment has an integrated spacer that takes the place of the foam spacer.
Figure 9B:
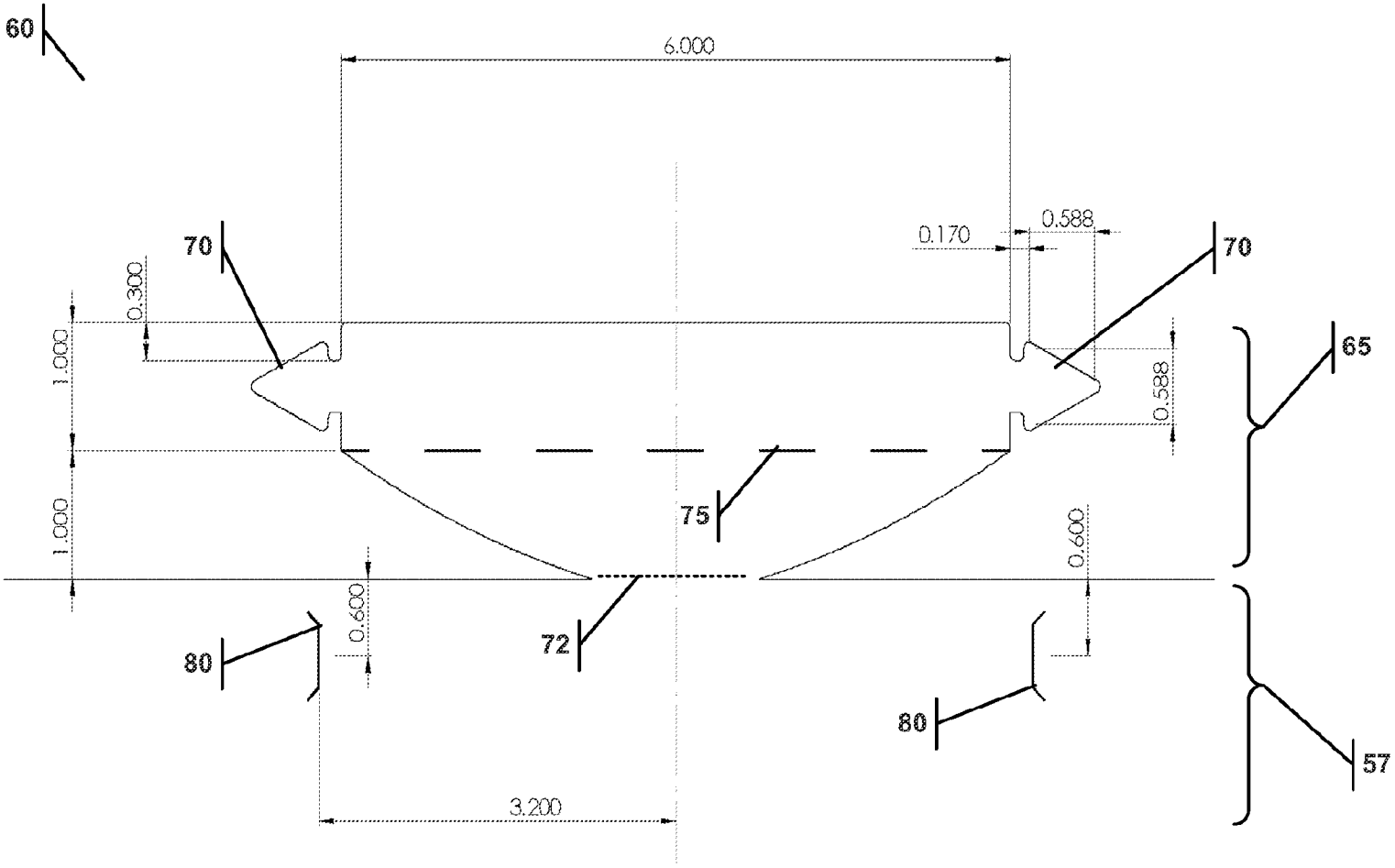
FIG. 9B is an enlarged view of the integrated spacer.
Figure 10A:
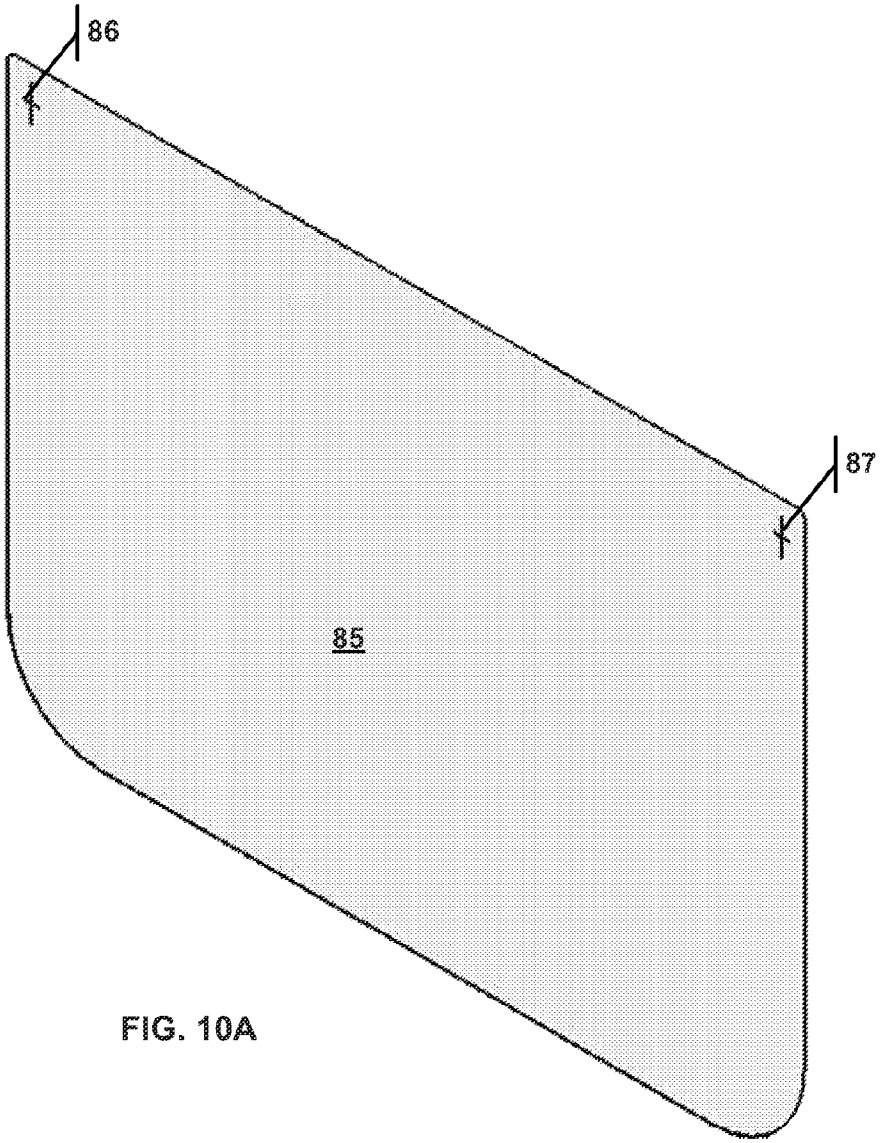
FIG. 10A is an isometric view of a sixth embodiment of the face shield body with two strap slots on either side of the body that receive an anchor/barb from the barbed elastic strap (shown in FIGS. 11A and 11B).
Figure 10B:
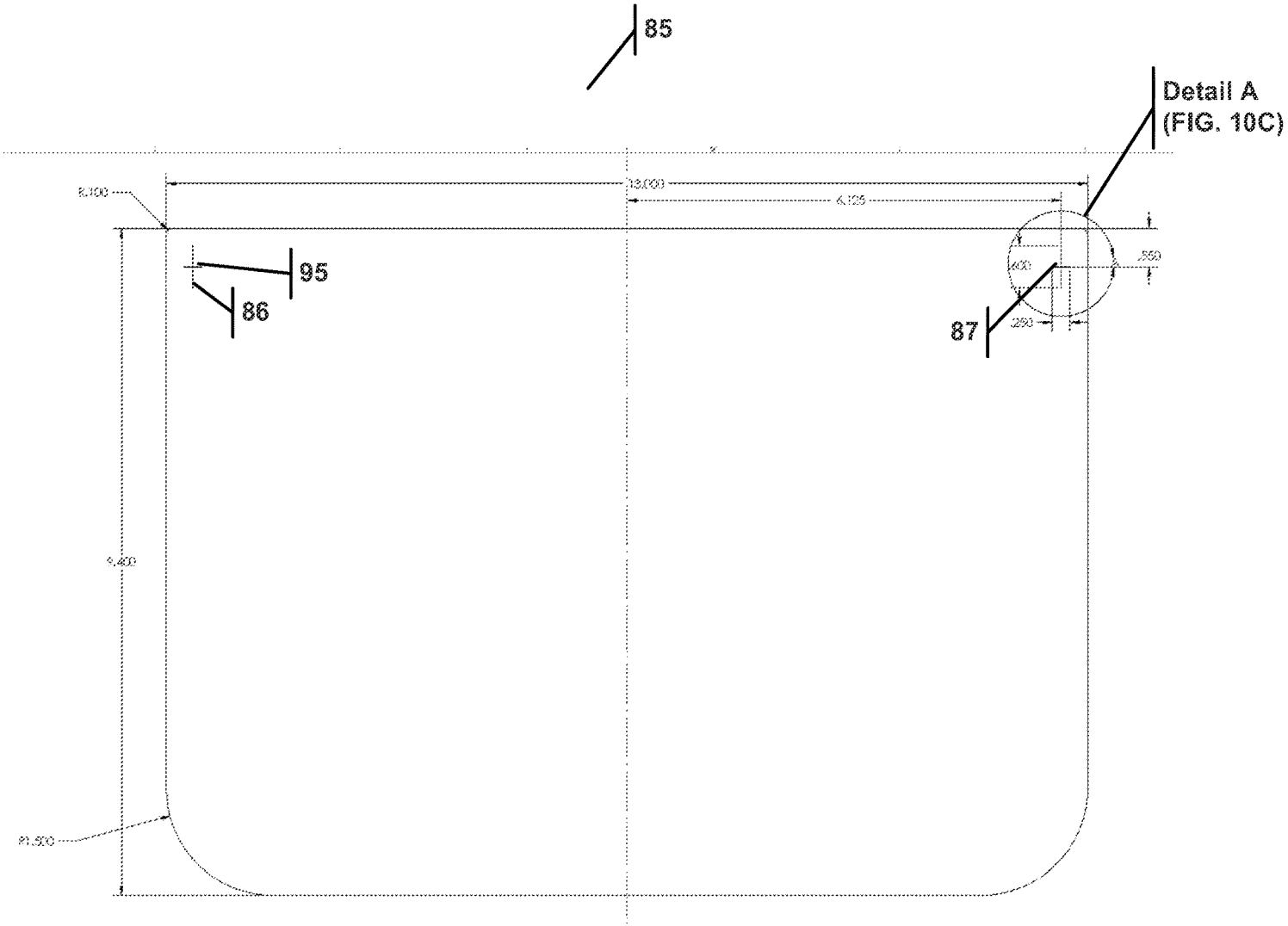
FIG. 10B is a plan view having dimensions of the sixth embodiment of face shield body with two strap slots on either side of the body that receive an anchor/barb from the barbed elastic strap (shown in FIGS. 11A and 11B).
Figure 10C:
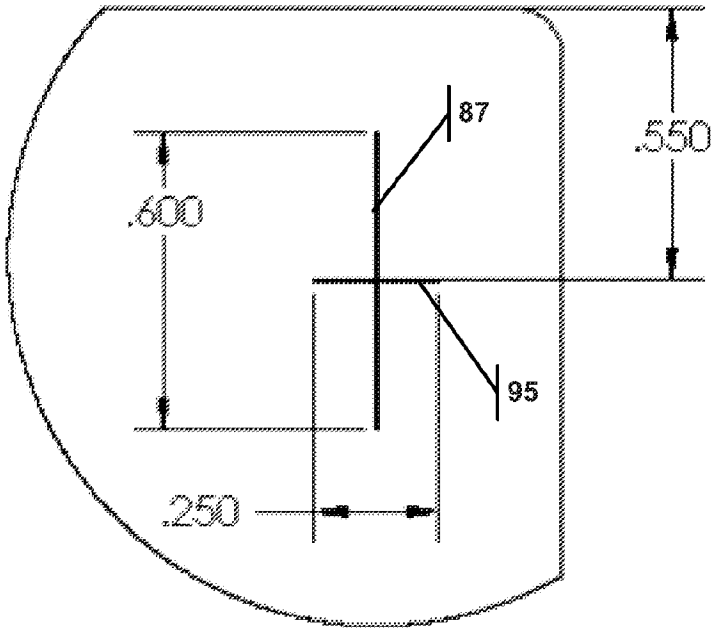
FIG. 10C is an enlargement of Detail A from FIG. 10B showing the detail of the strap slots and the orthogonal strap slots.
Figure 11A:
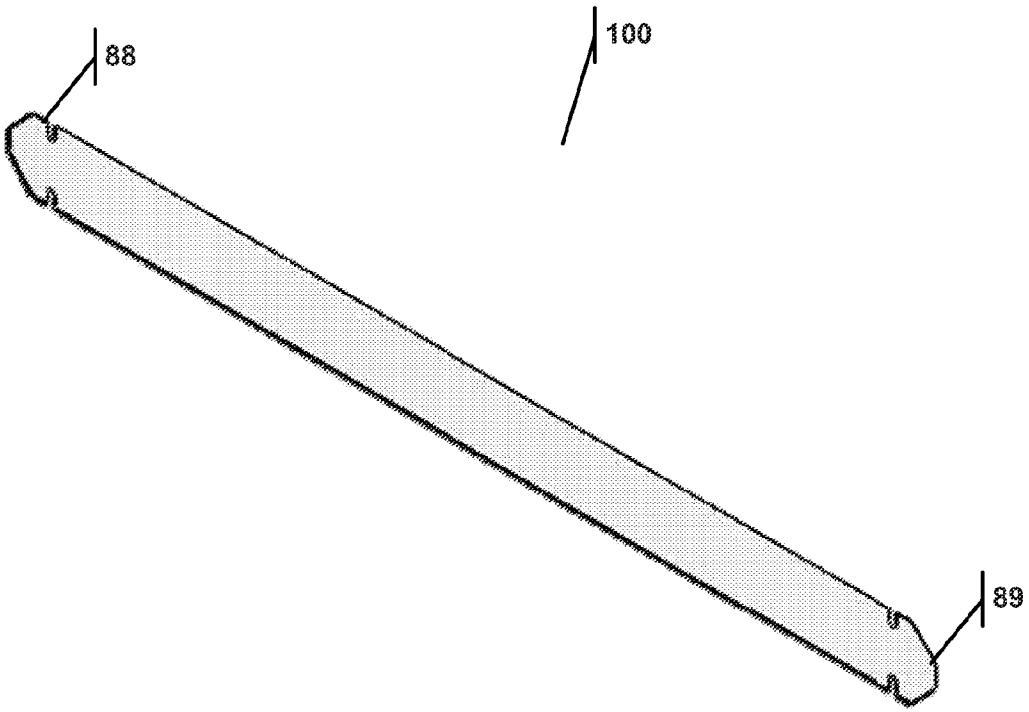
FIG. 11A is an isometric view of a barbed elastic strap having two anchor/barbs, one on either end, which can be used to secure the elastic strap to the face shield body shown in FIGS. 10A-10C.
Figure 11B:
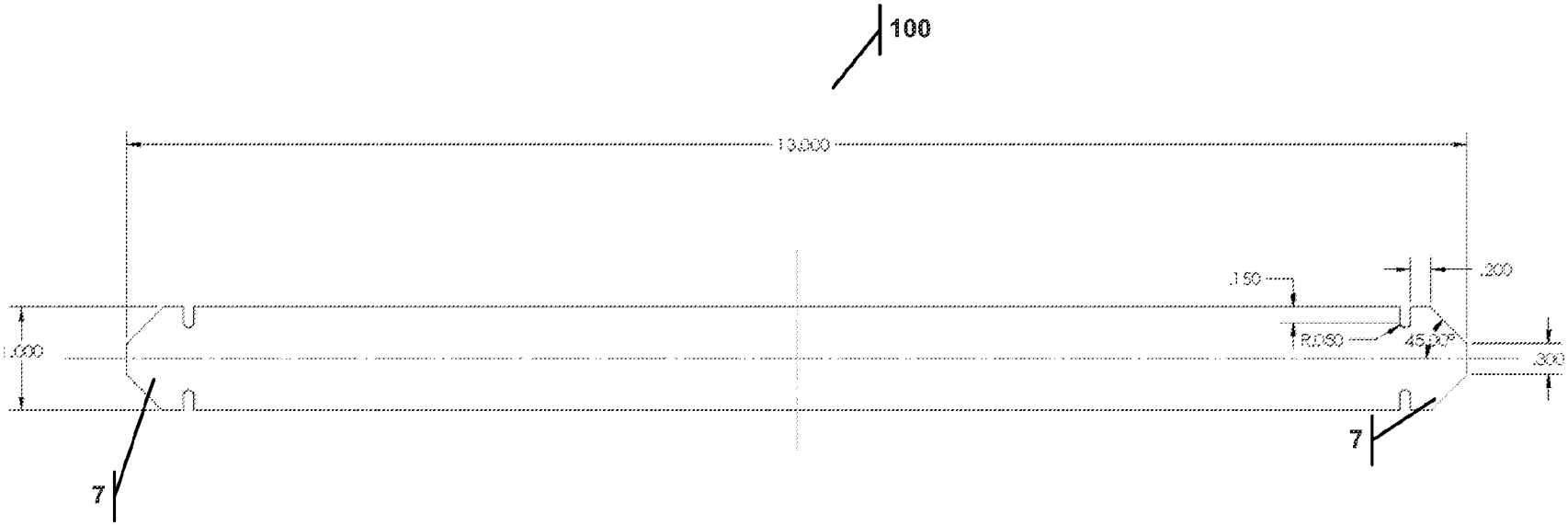
FIG. 11B is a plan view having the dimensions of the barbed elastic strap of FIG. 11A.

The present invention presents many embodiments and many aspects that may be used independently or in conjunction. One of these aspects is a more secure method of attaching the elastic strap, which secures the face shield to the user's head, to the face shield body. This and other aspects will be more easily understood once the construction of the face shield body is explained in terms of the details shown in FIGS. 1-6B. FIGS. 1 and 4A-4D illustrate a first embodiment of a face shield body 5-1, FIGS. 2 and 6A-B illustrate a second embodiment for the face shield body 5-2, FIGS. 3A, 3B illustrate a third embodiment for the face shield body, and FIGS. 5A-B illustrate a fourth embodiment for the face shield body 5-4. A fifth embodiment with a one-piece construction is shown in FIGS. 9A and 9B, a sixth embodiment where the strap comprises the anchor/barb is shown in FIGS. 10A-C, and a seventh embodiment (similar to embodiments one through four) is shown in FIGS. 12A-12F, where the face shield extends over the user's ears.

Figure 13:
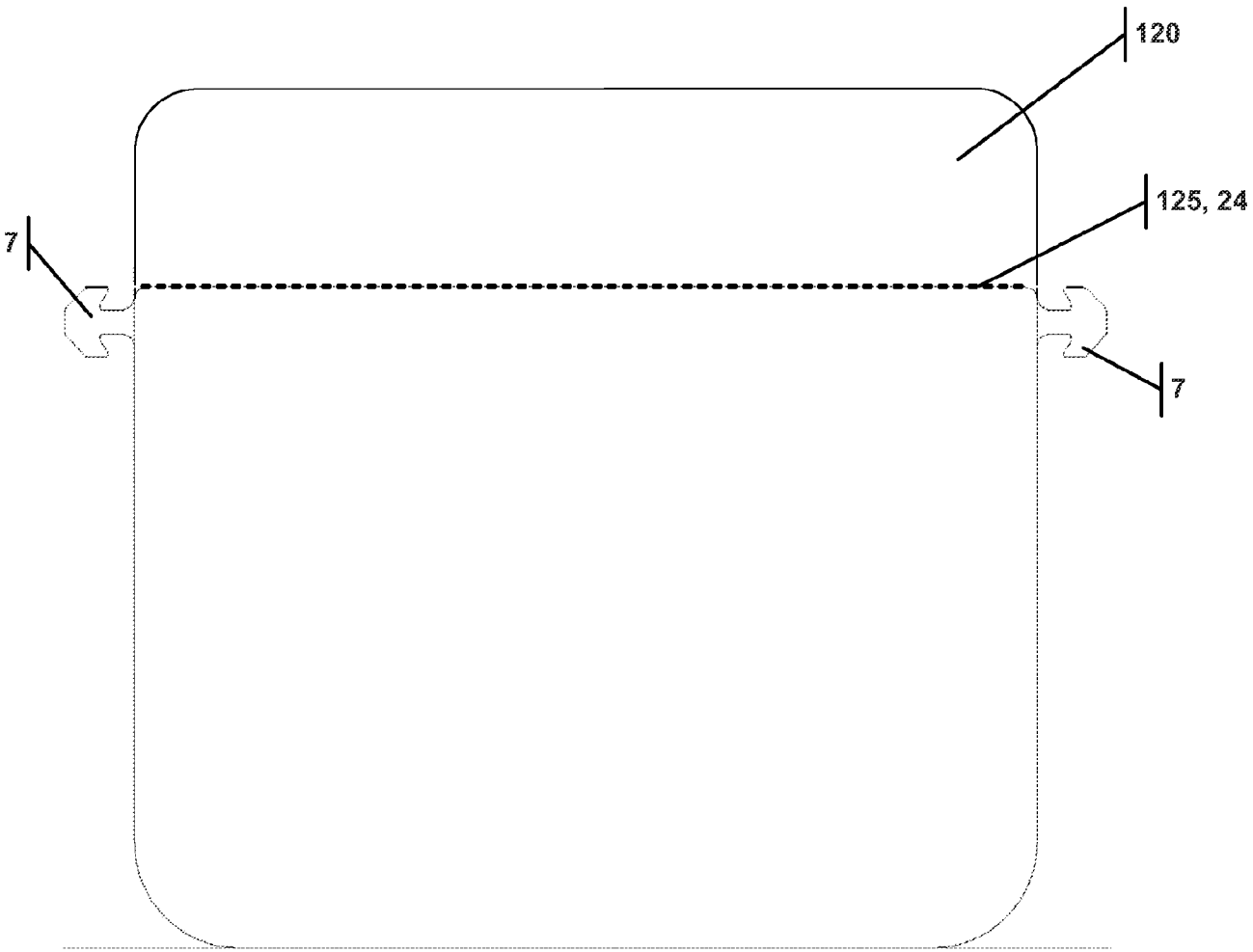
FIG. 13 illustrates a top edge extension.

FIG. 1 illustrates the face shield body 5-1 with a transparent surface 6 having a first side edge 21, a second side edge 22, and a top edge 23. Each side edge (21, 22) further comprises an anchor/barb 7, wherein the anchor/barbs may be positioned at or near the top edge 23. It should be noted that, if a top edge extension 125 as shown in FIG. 13 is used, then the anchor/barbs 7 will not be positioned at or near the top edge 23. Returning to FIG. 1, the face shield body frame 10-1 is formed by the top edge 23, the first side edge 21, and the second side edge 22.

The difference between the embodiments 5-1, 5-2, 5-3, 5-4 for the face shield body lies in the design and placement of the anchor/barb 7. In the first embodiment face shield body 5-1, the anchor/barbs 7 are within the face shield body frame 10-1 (FIG. 4B). In the second embodiment face shield body 5-2, the anchor/barb extends completely out of the face shield body frame 10-2 (FIG. 6B) and are connected to the face shield body 5-2 by the necked region 26. In the third embodiment face shield body 5-3, the anchor/barbs 7 also extend beyond the side edges (21, 22) of the transparent surface 6 (i.e., the face shield body frame 10-3), and are located at the ends of an elongate tab 20 that extends for a distance 15 beyond the face shield body frame 10-3 (FIG. 3A). In the fourth embodiment face shield body 5-4, the anchor/barbs 7 only partially extend beyond the face shield body frame 10-4 (FIG. 5B). The face shield body may be made of a transparent material such as polyethylene terephthalate (PET) plastic. The material may be tinted and/or coated, for example, to filter out UV light, or to prevent fogging up, or to prevent static.

Figure 4A:
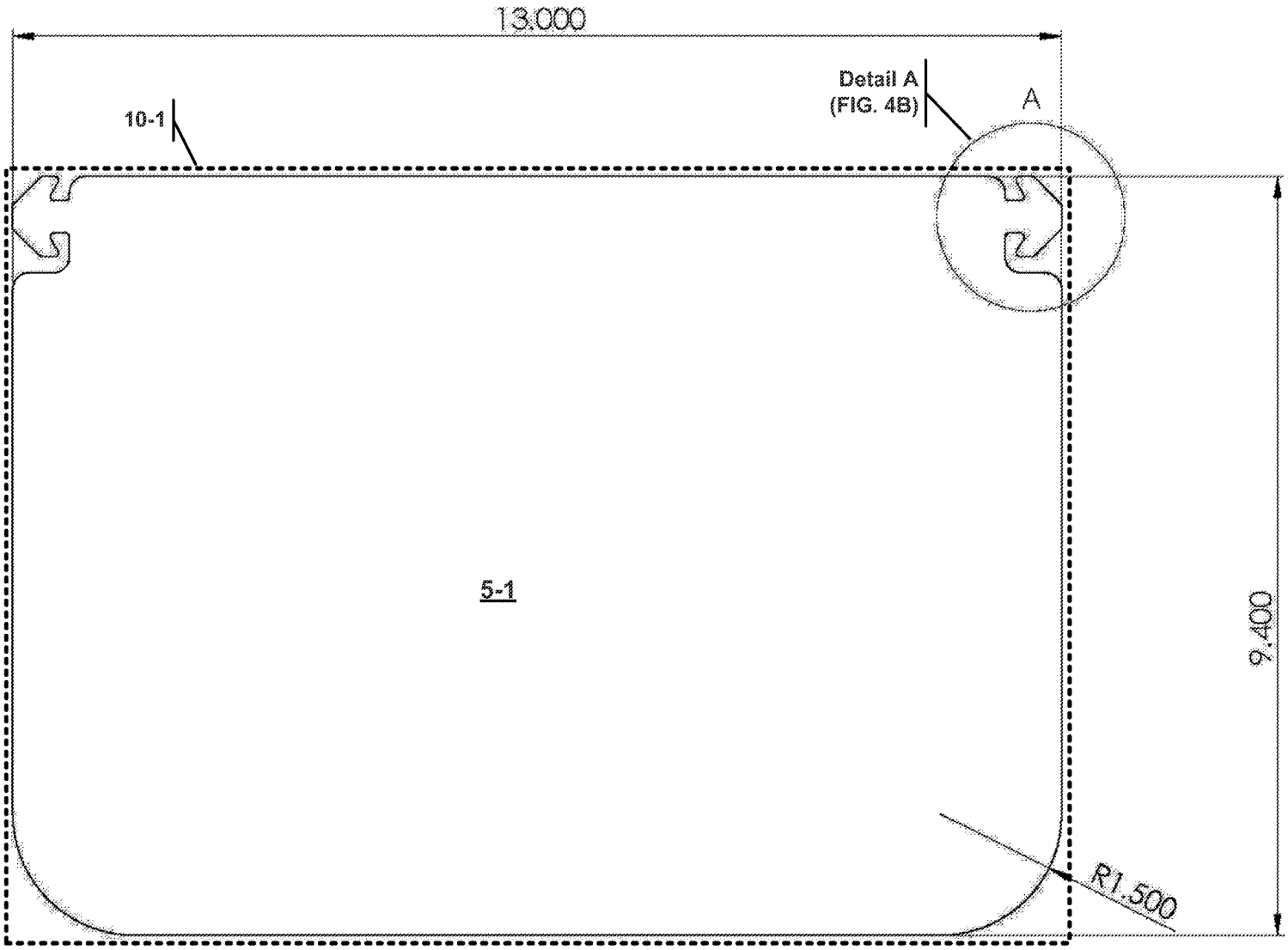
FIG. 4A is a plan view having dimensions of the first embodiment of a face shield body with two anchors or barbs on either side of the body, wherein the anchors/barbs are within the frame defined by the body.
Figure 4B:
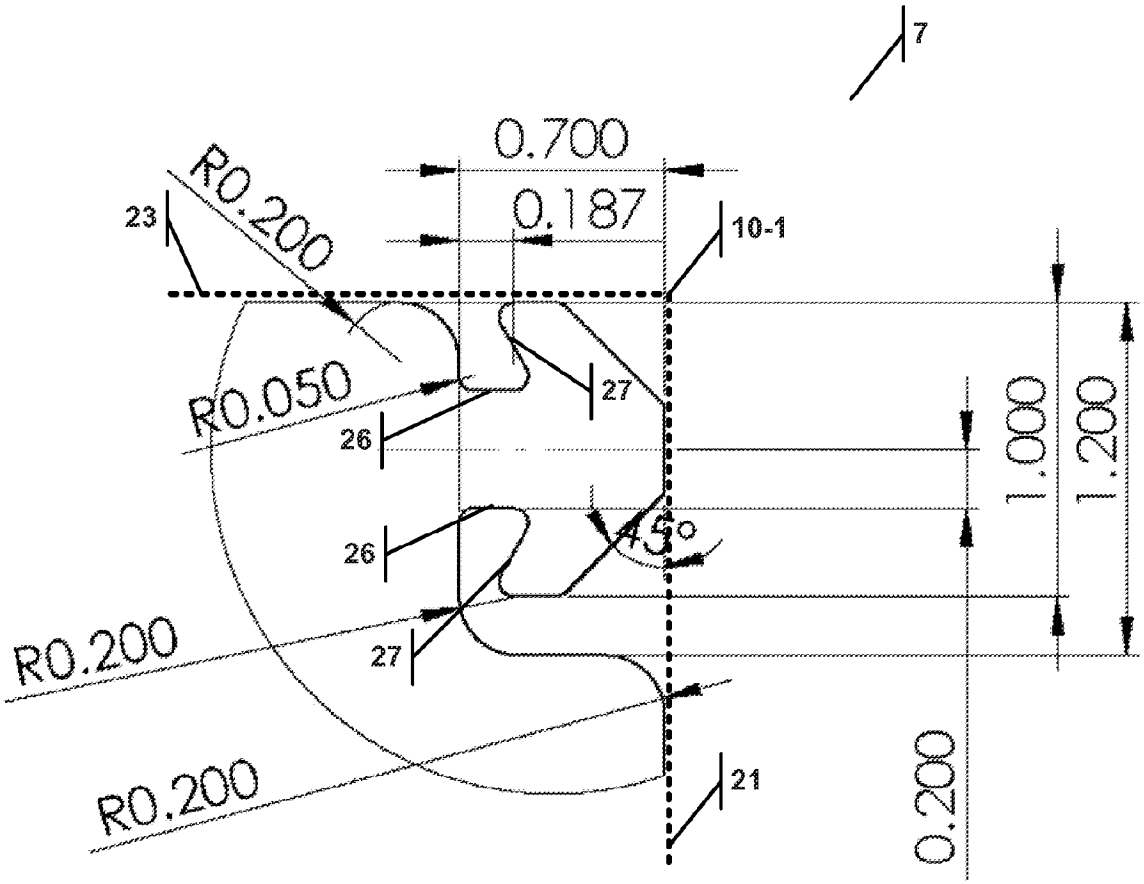
FIG. 4B is an enlargement of Detail A from FIG. 4A, showing the detail of the anchor/barb.
Figure 4C:
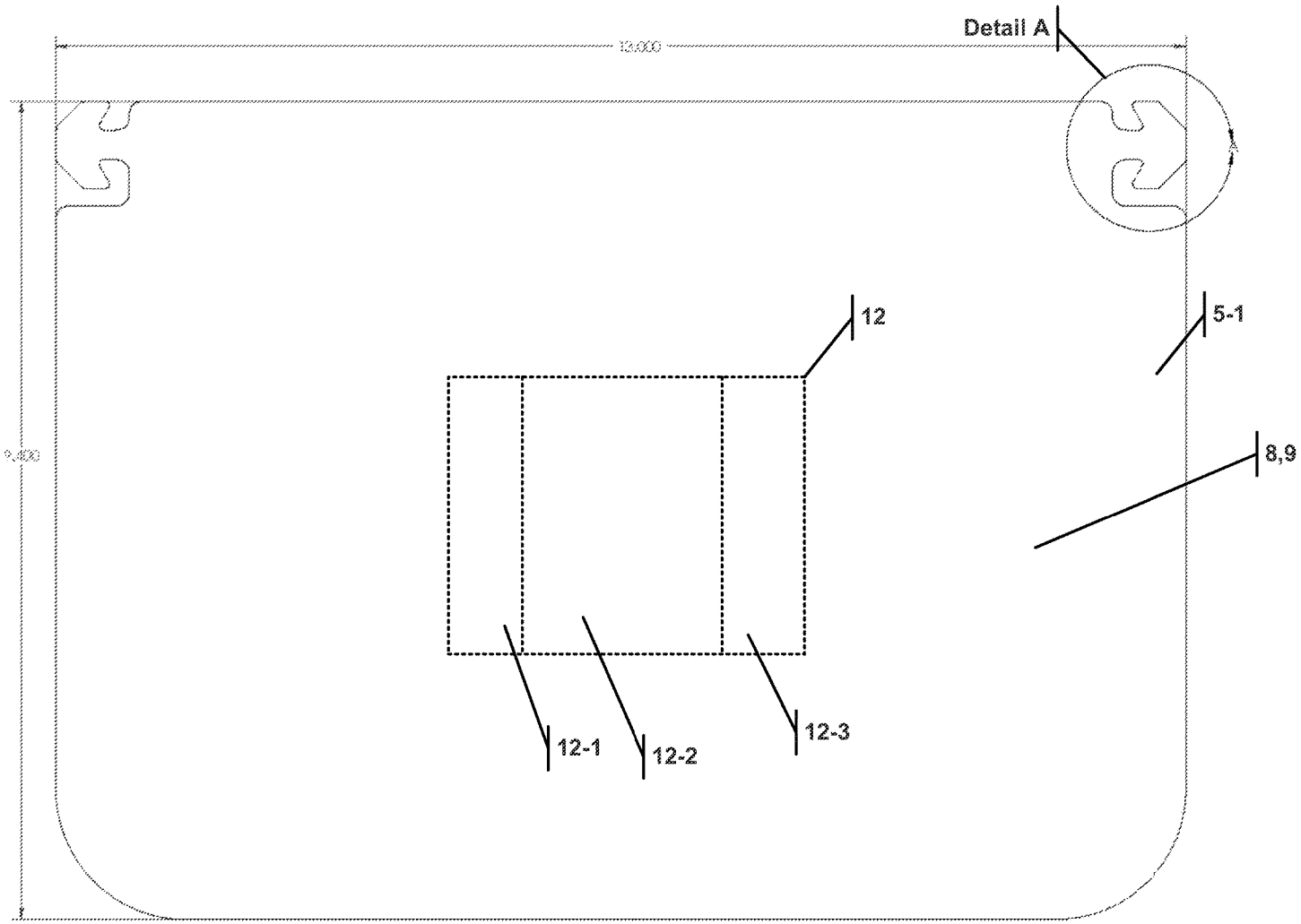
FIG. 4C is a plan view of the first embodiment of the face shield body with a magnification region.
Figure 7A:
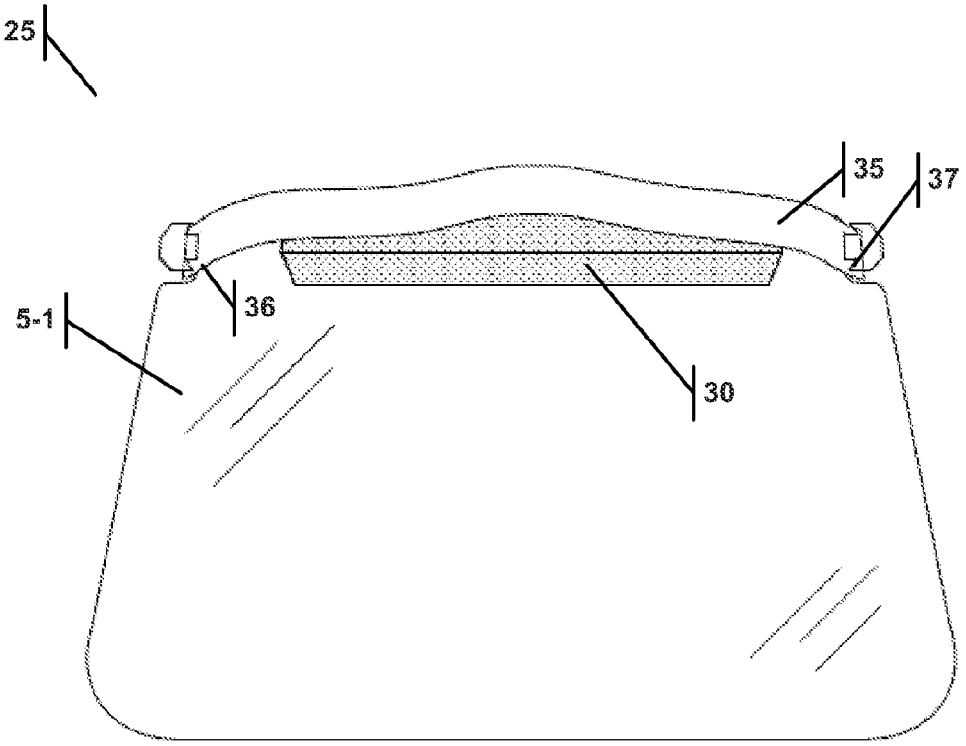
FIG. 7A is a back-view photograph showing the three-piece construction (face shield body, foam and slotted elastic strap) of a completed face shield using the first embodiment of the face shield body.
Figure 7B:
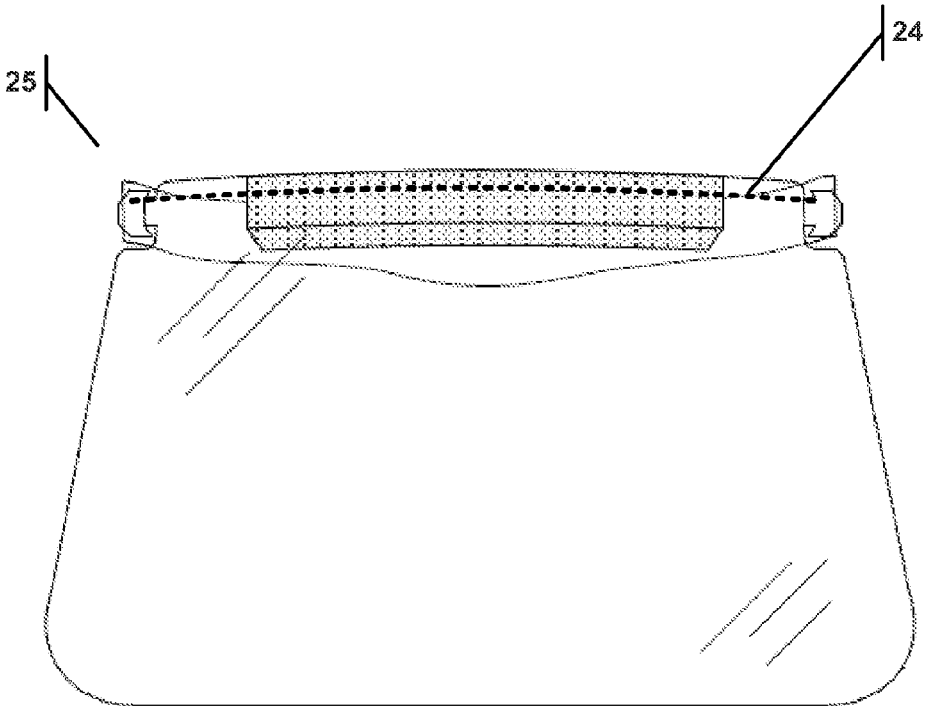
FIG. 7B is a front-view photograph showing the three-piece construction of a completed face shield using the first embodiment of the face shield body.
Figure 7C:
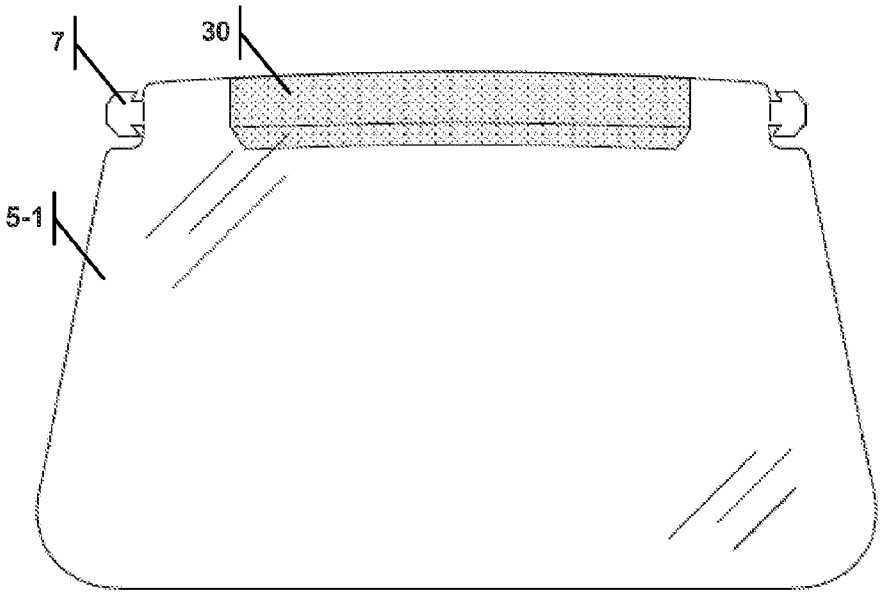
FIG. 7C is a front-view photograph of the anchor/barb of a completed face shield using the first embodiment of the face shield body, with the slotted elastic strap removed.
Figure 7D:
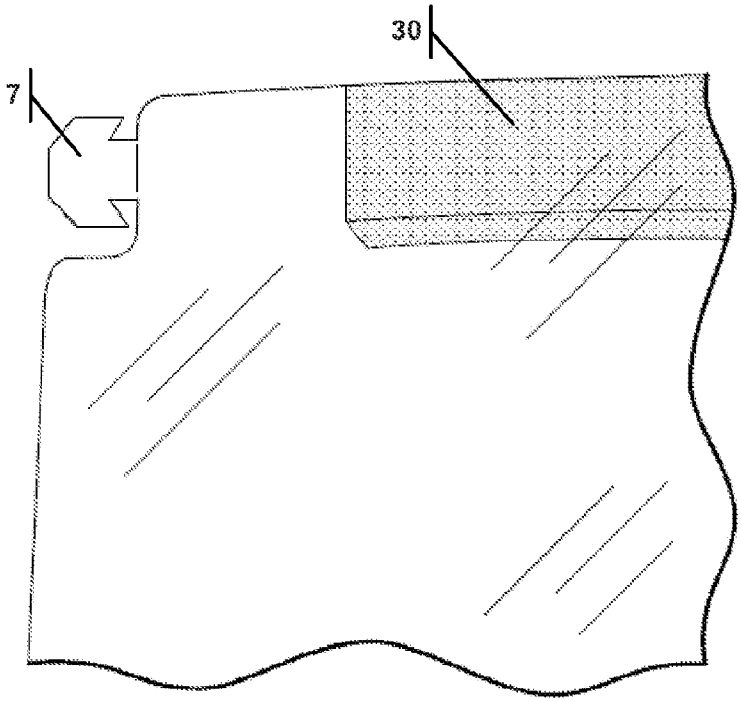
FIG. 7D is an enlarged front-view photograph of the right anchor/barb of a completed face shield using the first embodiment of the face shield body, with the slotted elastic strap removed.
Figure 7E:
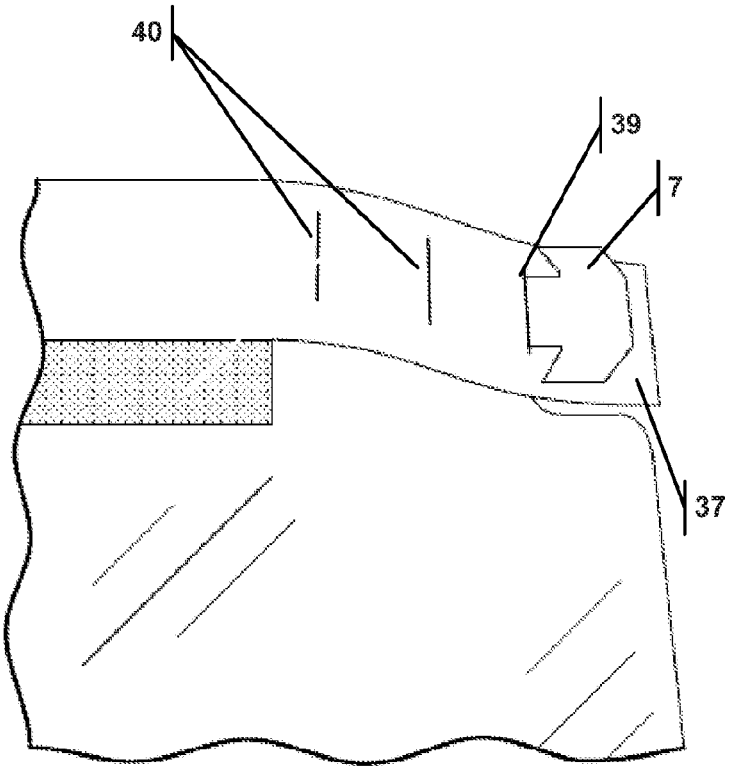
FIG. 7E is an enlarged back-view photograph of the right-side anchor/barb of a completed face shield using the first embodiment of the face shield body, with the slotted elastic strap attached to the anchor-barb.
Figure 7F:
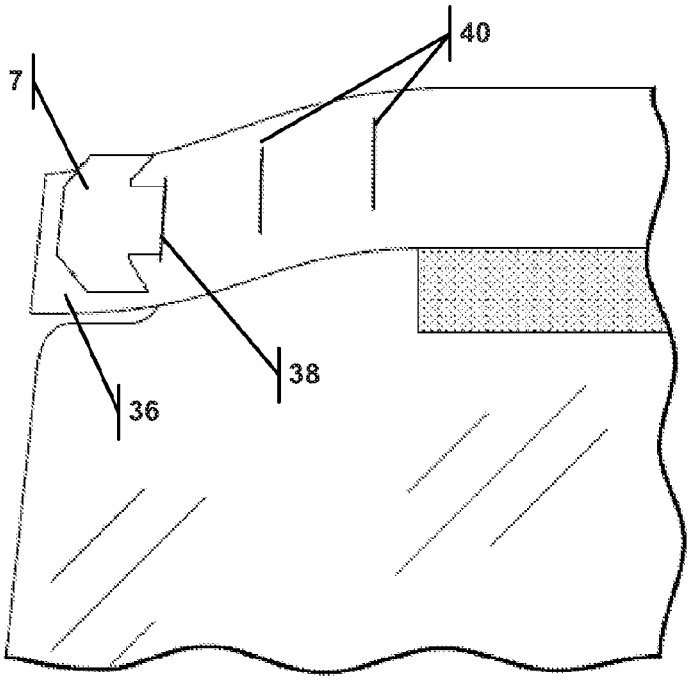
FIG. 7F is an enlarged back-view photograph of the left-side anchor/barb of a completed face shield using the first embodiment of the face shield body, with the slotted elastic strap attached to the anchor-barb.
Figure 8B:
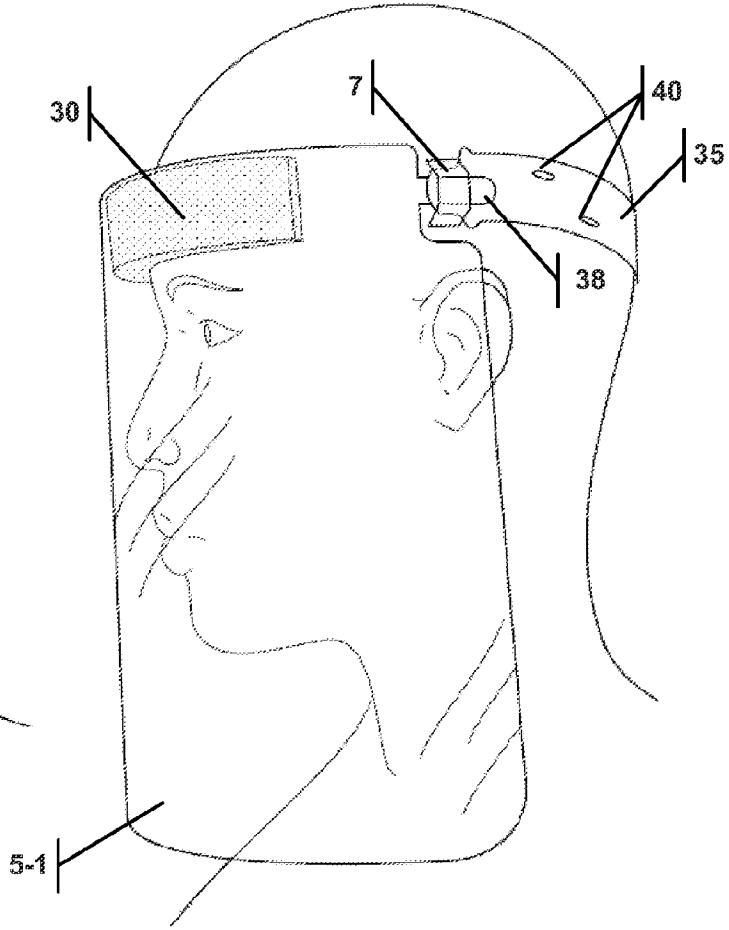
FIG. 8B is a right-side view of the completed face shield worn by a user.
Figure 8A:
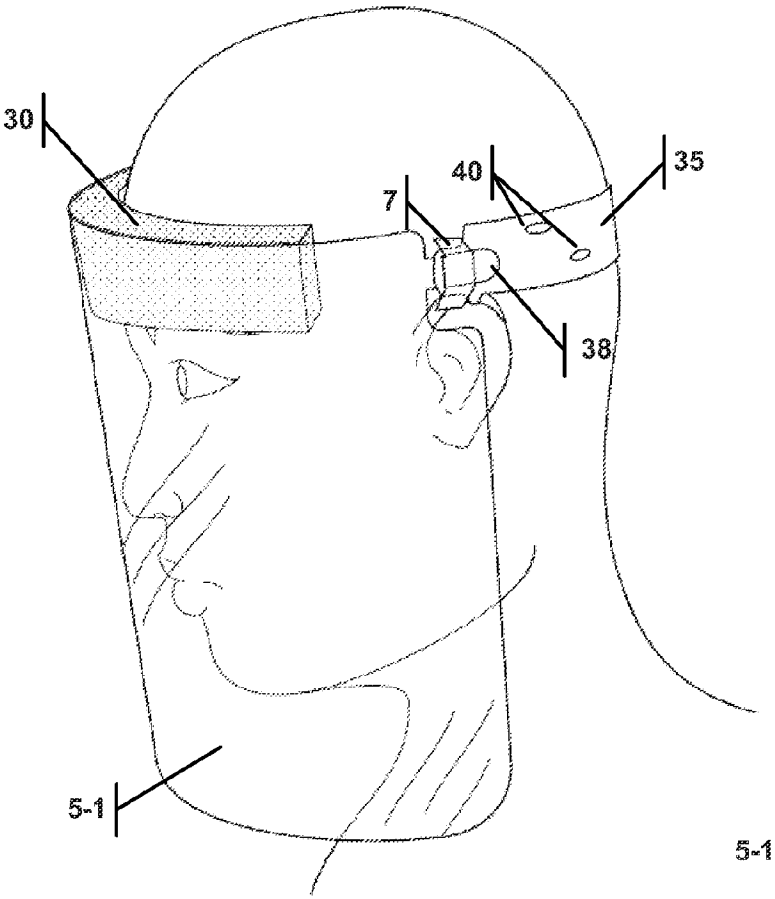
FIG. 8A is a right-side view of the completed face shield worn by a user.
Figure 8D:
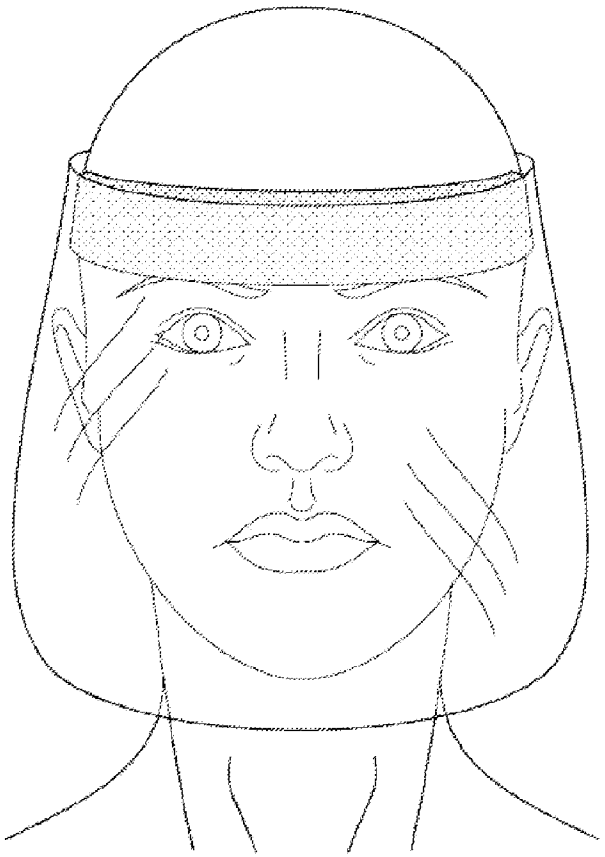
FIG. 8D is a front-view of the completed face shield worn by a user.
Figure 8C:
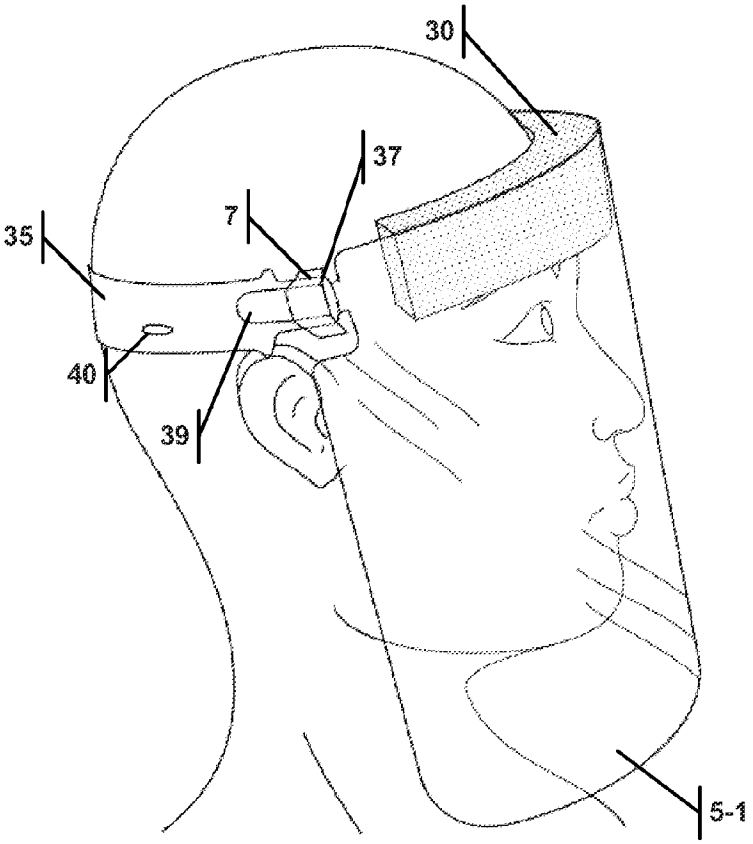
FIG. 8C is a left-side view of the completed face shield worn by a user.

Turning now to FIG. 4A, this plan view shows that the anchor/barbs 7 in the circled region A lie within the face shield body frame 10-1. The enlarged detail A from FIG. 4A is shown in FIG. 4B. Note that the anchor/barb 7 comprises a necked region 26 and a flared region 27. The anchor/barb 7 is designed to fit into a slot on the elastic strap 35 (FIGS. 7A-7F) to secure the face shield to the user's head to cover the user's eyes, nose and mouth. The elastic strap 35 is slotted with at least a first slot 38 (FIG. 7F) and a second slot 39 (FIG. 7E), where the first slot 38 is constructed to receive the first anchor/barb 7 near the first side edge 21, and the second slot 39 is constructed to receive the second anchor/barb 7 near the second side edge 22. The elastic strap 35 may also have several adjustment slots 40 that allow the user to adjust the fit of the face shield; preferably, each individual slot is separated by a quarter inch. When the user wears the face shield, the elastic strap 35 would be in a stretched configuration and pulls on the first and second anchor/barbs 7. When in a stretched configuration, the first slot 38 would surround the necked region 26 of the first anchor/barb 7 and abut the flared region 27. The flared region 27 prevents the first slot 38 from fully detaching from the first anchor/barb 7. Thus, in the stretched configuration, the first slot 38 is detachably affixed to the first anchor/barb 7, and the second slot 39 is detachably affixed to the second anchor/barb 7.

FIGS. 7A-7F, which show various views of the completed three-piece mask 25, also shows a foam spacer 30 attached at or near the top edge and extending away from the face shield body 5-1. It should be noted that, if a top edge extension 125 shown in FIG. 13 is used, then the foam spacer 30 will not be positioned at or near the top edge 23; rather, it will be positioned along a line originating from one anchor/barb, extending to the other anchor/barb (shown as line 24 in FIG. 7B). The foam spacer 30 is provided not only for the benefit of the user's comfort, but also provides some distance between the user's eyes and the transparent surface 6 for maintaining good visibility. The spacer 30 may be comprised of compressible material such as foam, polyurethane foam and/or anti-microbial foam. The spacer as shown in FIGS. 9A and 9B may be integrated with the face shield body and therefore is comprised of transparent sheet itself. This spacer (1) provides spacing between the user's face and the face shield body, (2) makes the face shield more comfortable to wear, (3) provides a seal against the user's forehead, and (4) anchors the face shield against the user's forehead to lessen unwanted movement.

FIGS. 8A-8D are provided to indicate how the face shield would fit on a user's head.

Returning to FIG. 4C, the face shield body 5-1 and the transparent surface 6 forms the face shield body may be comprised of an anti-fog material 8 and/or an anti-viral material 9, so that the face shield has improved function in preventing viral particles from infecting the user, and in providing visibility through the face shield for the user. For users such as medical workers who benefit from a magnified viewing area, the transparent surface 6 may further comprise a magnification region 12, which may be made from a Fresnel lens or lenses. The magnification region 12 comprises a plurality of magnification areas 12-1, 12-2, 12-3 based on the transparent surface curvature. In other words, since the transparent surface 6 is curved, the plurality of magnification areas that comprise the magnification region 12 may be designed to adjust for the effect of bending of light through the curvature so as to reduce distortion that may be visible through the magnification region 12, compared to prior art. Because a conventional flat magnification plastic is meant to be used on papers or books, there is no built-in distortion adjustment for bending the plastic along the curved surface of the face shield body when being worn. Thus, the outer left and right edges become distorted under magnification, limiting the value of magnification. By creating the plastic magnification region 12 inserts with the curve distortion calculation, the face shield body of the present invention provides an alternative to a user having to wear reading glasses while in PPE gear. The methods of attachment could include, but are not limited to: adhesive tape or glue, thermal welding or physically cutting a window in the face shield to accept the magnification insert. The face shield body may also have an anti-fog treatment and/or an added anti-viral additive that would bind to the surface of the face shield body. A non-limiting way to accomplish this is to treat the surface with the anti-fog or anti-viral additive, or to impregnate the anti-fog or anti-viral additive into the plastic face shield body material during the extrusion process. In the latter method, the anti-viral additive would then bloom to the surface and exhibit the anti-viral trait. The anti-viral additive can lower the half-life of a pathogen that lands on the surface of the face shield. The additive may include, but are not limited to, copper, silver, zinc, copper alloys, brass, bronze, nickels and heavy metals. Other chemical anti-viral additives include, but are not limited to, triclosan.

Figure 4D:
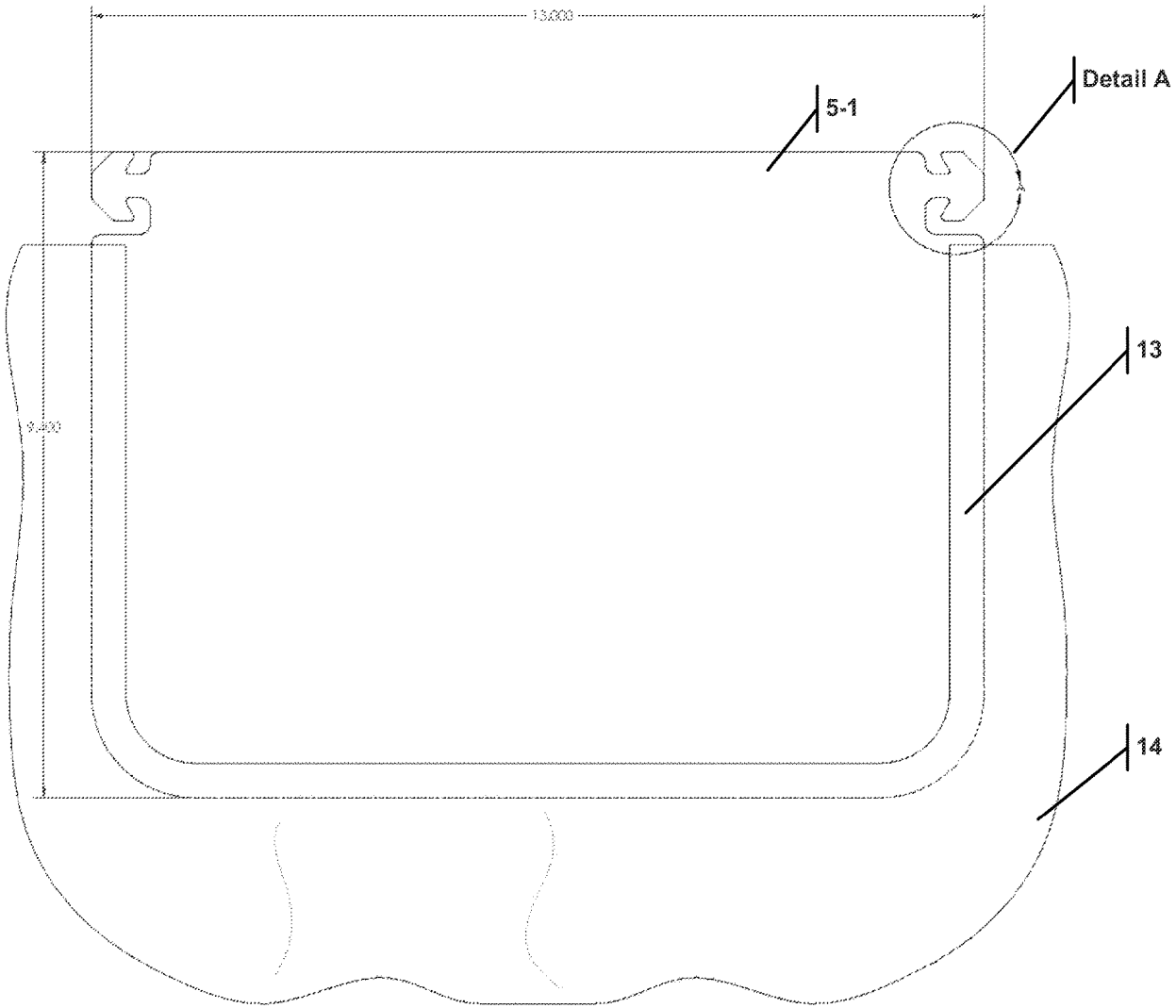
FIG. 4D is a plan view of the first embodiment of the face shield body with a cloth-like edge material adhered to the edge of the face shield body.

FIG. 4D is a plan view of the first embodiment of the face shield body 5-1 with a cloth-like edge material 14 adhered to the edge of the face shield body. While shown on a portion of the face shield body edge (i.e., the two sides and the bottom), this material 14 may also completely circumnavigate the face shield body edge. FIG. 4D represents a non-limiting example of an adhesive 13 used to fix or attach the cloth-like edge material 14 to the edge of the face shield body 5-1. The edge material may also be comprised of foam material. Other methods of fixing the material would be known to those skilled in the art, and may include the non-limiting examples of stitching, welding and fastening.

FIG. 4D shows that the face shield 5-1 may further comprise a cloth-like edge material 14 attached to and extending laterally away from the first and second side edges and the bottom edge of the transparent surface 6. This cloth-like edge material 14 can provide the user further protection from respiratory hazards such as airborne particles like micro-droplets. It prevents the micro-droplets and aerosol particles from circumventing the edge of the face shield body and potentially entering the user's eyes, nose and/or mouth. The edge material may also have an embedded anti-viral property to lower the viral load and to shorten the half-life of potential infectious transmissions, including expelled infectious particles, aerosols, or droplets. The cloth-like edge material 14 can be electrostatically charged to repel airborne particles. It may be comprised of an absorbent wicking material, to wick away the user's sweat and to improve the user's comfort when wearing the face shield for long periods of time. The cloth-like edge material 14 may also be a polyester blend, an absorbent wicking material, a hydrophobic material or combinations thereof. The cloth-like edge material 14 is attached to the first and second edges (21, 22) by some means of an edge adhesive 13, which can include but is be limited to: adhesive, fastener, stitching and/or thermal welding.

FIG. 3A illustrates a third embodiment face shield body 5-3 and its face shield body frame 10-3. The anchor/barbs 7 extend 15 beyond the frame 10-3 by way of elongate tabs 20. In the enlarged view of Detail A, presented in FIG. 3B, the anchor/barb 7 also features a necked region 26 and a flared region 27. The anchor/barb 7 does not extend above the transparent surface top edge 23. Rather, it extends 15 beyond the frame only to the side, so that the extension beyond the frame 15 occurs beyond the transparent surface first side edge 21.

FIG. 5A shows a fourth embodiment face shield body 5-4 and the face shield body frame 10-4, and that the anchor/barbs 7 extend 15 beyond the frame 10-4. In the enlarged view of Detail A, presented in FIG. 5B, the anchor/barb 7 also features a necked region and a flared region. The anchor/barb 7 does not extend above the transparent surface top edge 23. Rather, it extends 15 beyond the frame only to the side, so that the extension beyond the frame 15 occurs beyond the transparent surface first side edge 21.

In FIG. 6A, the second embodiment face shield body 5-2 and the face shield body frame 10-2 are shown. FIG. 6A illustrates that the anchor/barb 7 lies outside the face shield body frame 10-2 in the horizontal direction. In the vertical direction, the edge of the anchor/barb 7 is continuous with the top edge 23 of the face shield body frame 10-2.

Other aspects of the present invention are better understood from following FIGS. 9A-12D. FIGS. 9A-9B illustrate a fifth embodiment of a face shield 45 where the transparent surface 6 has a bulk region 57, an integrated spacer region 60, and a fold line 72 separating the bulk region 57 from the integrated spacer region 60, wherein the fold line 72 is along the top edge 23 of the face shield body. This embodiment features two elongate tabs 50, 55. The first elongate tab 50 extends away from the first edge and at the end has an anchor/barb 7 with a necked region and a flared region (such a construction is described above). The second elongate tab 55 extends away from the second edge and at or near its end has slots 40 constructed to receive the anchor/barb 7. The edge of either elongate tab 50 or 55 may be continuous with the top edge 23; although this need not be so to maintain functions, the continuous edge would enhance the simplicity of construction. When the user wears the face shield, the anchor/barb 7 is inserted into the slot 40 such that the slot 40 surrounds the necked region and abuts the flared region, and the flared region prevents the slot 40 from fully detaching from the anchor/barb 7. Unlike the previous embodiments described herein, the fifth embodiment illustrated in FIGS. 9A-9B does not require a separate elastic strap; instead, the strap is integrated into the face shield body 47. The features of a magnification region, various material of the transparent surface, and the cloth-like edge material and edge adhesive discussed in previous paragraphs, as well as variations upon the features discussed as would be apparent to one skilled in the art, may also be used with this embodiment.

FIG. 9B shows more detail of the integrated spacer region 60. The integrated spacer body 65 may be folded along line 72 to extend away from the bulk region 57. The spacer body 65 may be again folded at line 75 such that integrated spacer barb 75 may be inserted into the barb slots 80. When the integrated spacer body 65 is folded along these two lines (i.e., lines 72 and 75), the fold line 75 is the contact point with the user's forehead.

The integrated spacer shown in FIGS. 9A and 9B may be used with any of the embodiments described herein and is indeed an improvement over the prior art and the other previously disclosed embodiments. First, because the spacer is integrated (as is the elastic strap), the entire mask can be constructed from a single piece of material—reducing manufacturing and shipping costs, and allowing the entire face shield to be easily cleaned. Second, when using a foam spacer 30 as shown in previous embodiments, the foam spacer 30 rests against the user's forehead when the mask or face shield is worn, and it may soak up sweat, becoming dirty, compressed, or uncomfortable over time.

FIGS. 10A-10C illustrate a sixth embodiment of the face shield body 85, whereby the placement of the anchor/barbs is on the elastic strap 35, and the placement of the slots 86, 87 corresponding to those anchor/barbs is on the face shield body 85. Shown in FIG. 10B, the face shield body 85 features a first face shield slot 86 and a second face shield slot 87, and either of these may have an orthogonal strap slot 95 (also shown in FIG. 10C) to accommodate the barbed elastic strap 100 shown in FIGS. 11A and 11B. An orthogonal strap slot 95 assists the user in inserting the anchor/barb from the bared elastic strap 100, which may be floppy and difficult to secure without the orthogonal strap slot 95. The barbed slotted elastic strap 100 features a first anchor/barb 88 at one end that is constructed to be received by the first face shield slot 86, and a second anchor/barb 89 at the other end that is constructed to be received by the second face shield slot 87. The face shield for covering the eyes nose and mouth of a user disclosed in FIGS. 10A-11B thus comprises a face shield body 85, a spacer (not shown), and an elastic strap 100.

The face shield body 85 includes a transparent surface having a first side edge, a second side edge, and a top edge, wherein the first side edge includes a first face shield slot 86, the second side edge includes a second face shield slot 87, and the first and second slots are positioned at or near the top edge. The spacer would be attached at or near the top edge and extend away from the face shield body. The elastic strap includes a first anchor/barb 88 and a second anchor/barb 89, wherein the first face shield slot 86 is constructed to receive the first anchor/barb 88, and the second face shield slot 87 is constructed to receive the second anchor/barb 89. When the user wears the face shield, the elastic strap 100 is in a stretched configuration and pulls on the first and second anchor/barbs, and in the stretched configuration, the first face shield slot 86 is detachably affixed to the first anchor/barb 88, and the second face shield slot 87 is detachably affixed to the second anchor/barb 89. The features of the magnification region, material of the transparent surface and the spacer, and the cloth-like edge material and edge adhesive discussed in previous paragraphs, as well as variations upon the features discussed as would be apparent to one skilled in the art, may also be used with this embodiment.

Figure 12A:
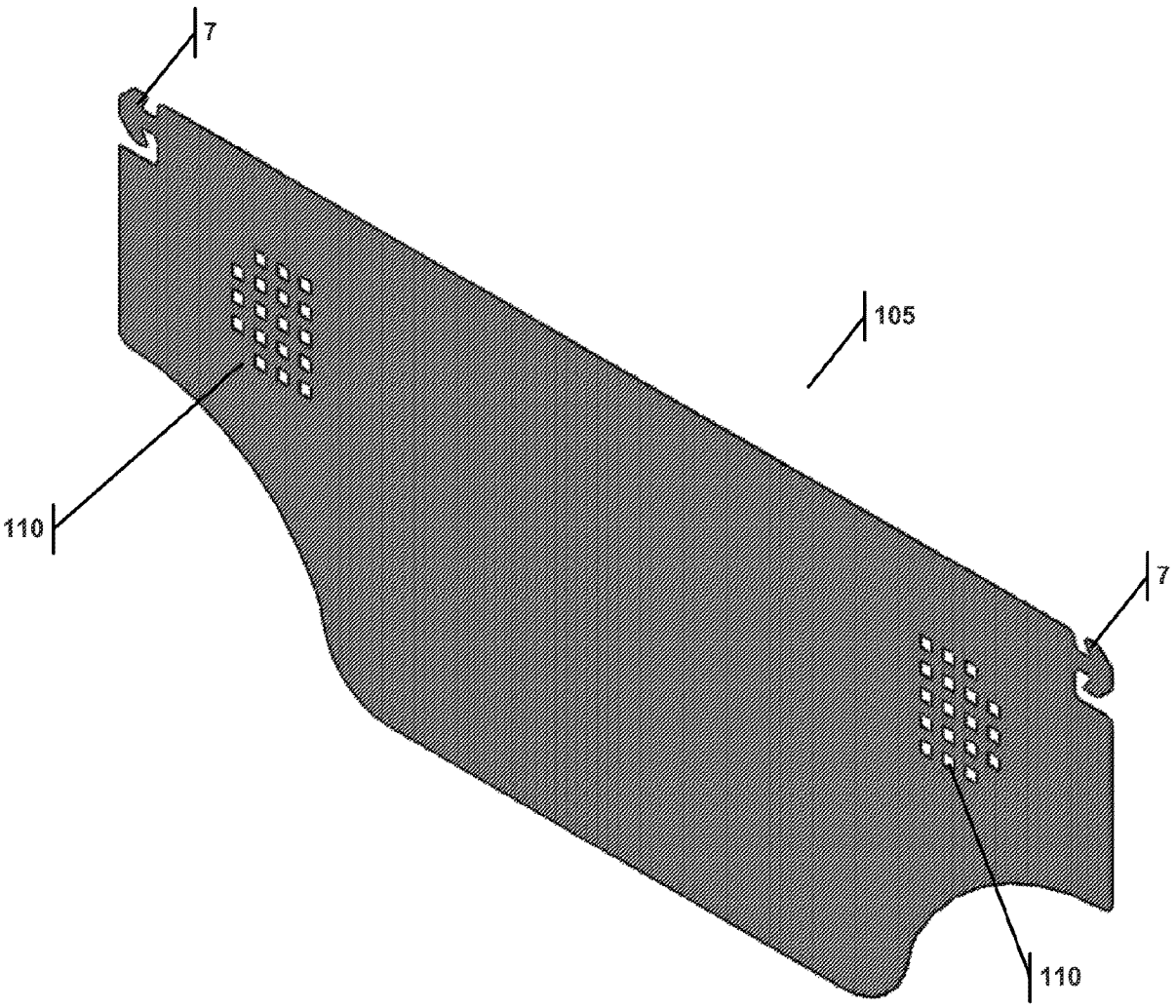
FIG. 12A is an isometric view of a seventh embodiment of the face shield body with two anchors or barbs on either side of the body, wherein the anchors/barbs are within the frame defined by the body.
Figure 12B:
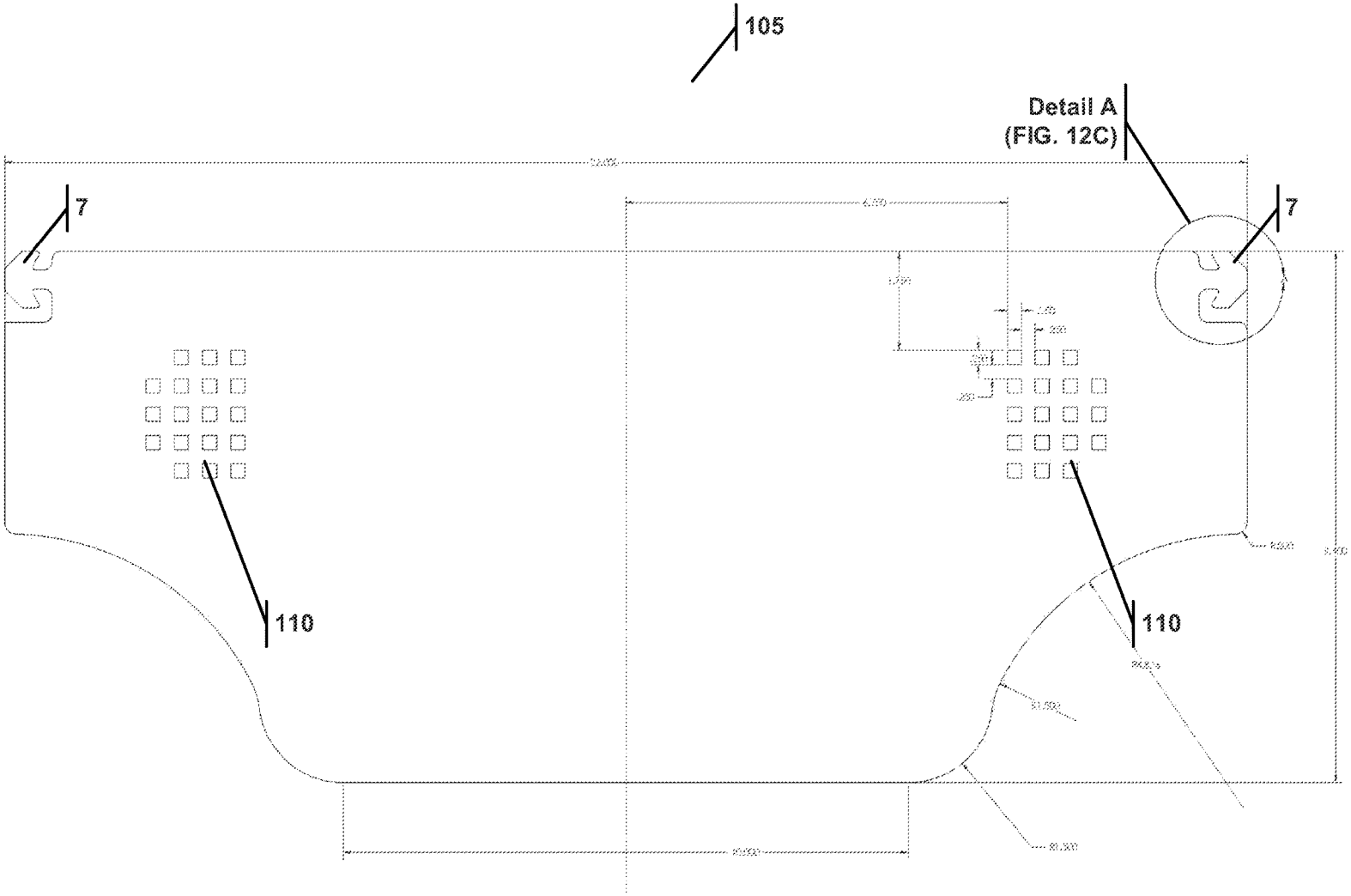
FIG. 12B is a plan view having dimensions of the seventh embodiment of the face shield body with two anchors or barbs on either side of the body, wherein the anchors/barbs are within the frame defined by the body, and the face shield further has hearing slots.
Figure 12C:
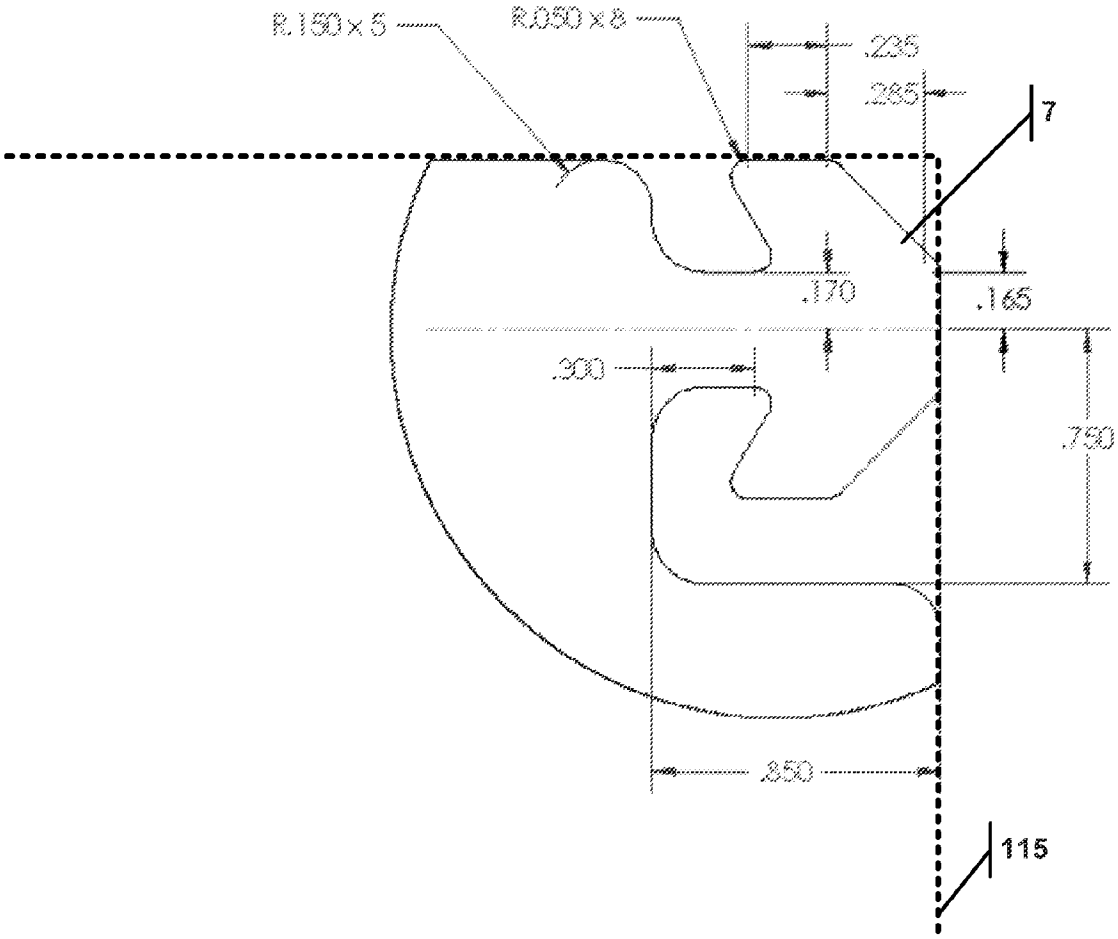
FIG. 12C is an enlargement of Detail A from FIG. 12B, showing the detail of the anchor/barb.
Figure 12D:
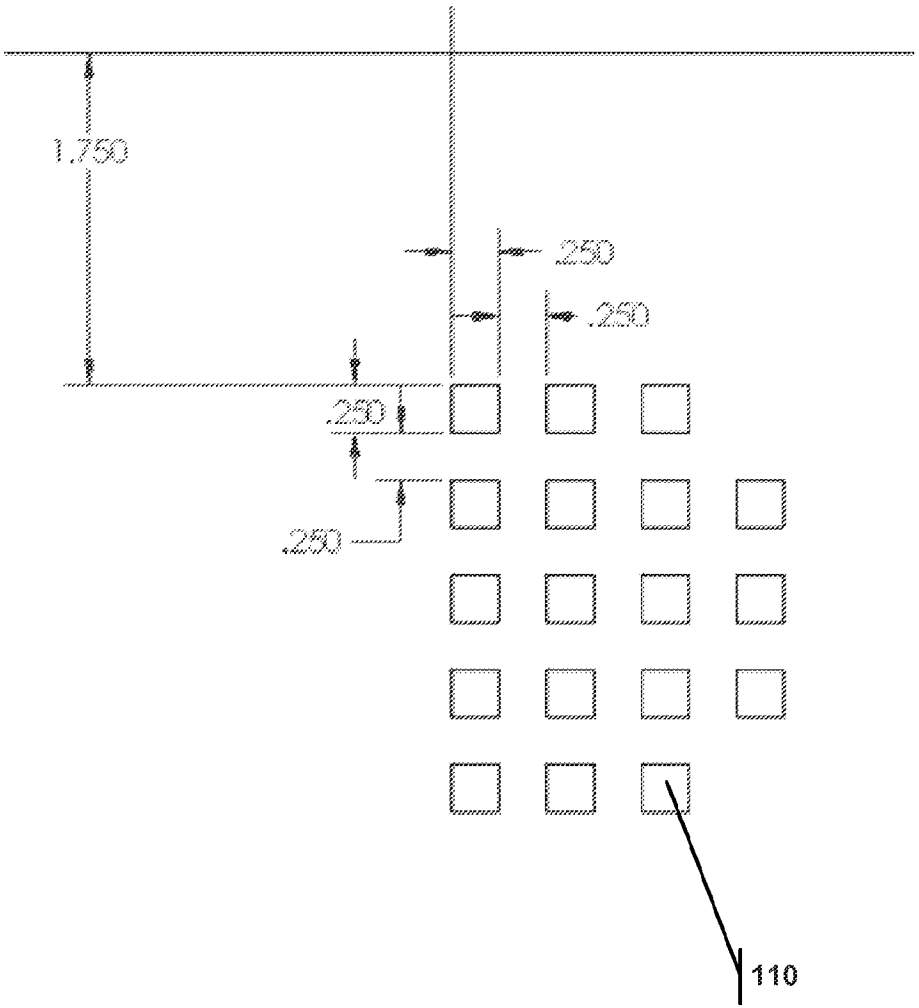
FIG. 12D is an enlargement of the hearing slots from FIG. 12B, showing the dimensions of those slots, which are preferably 0.250" and spaced 0.250" apart.
Figure 12E:
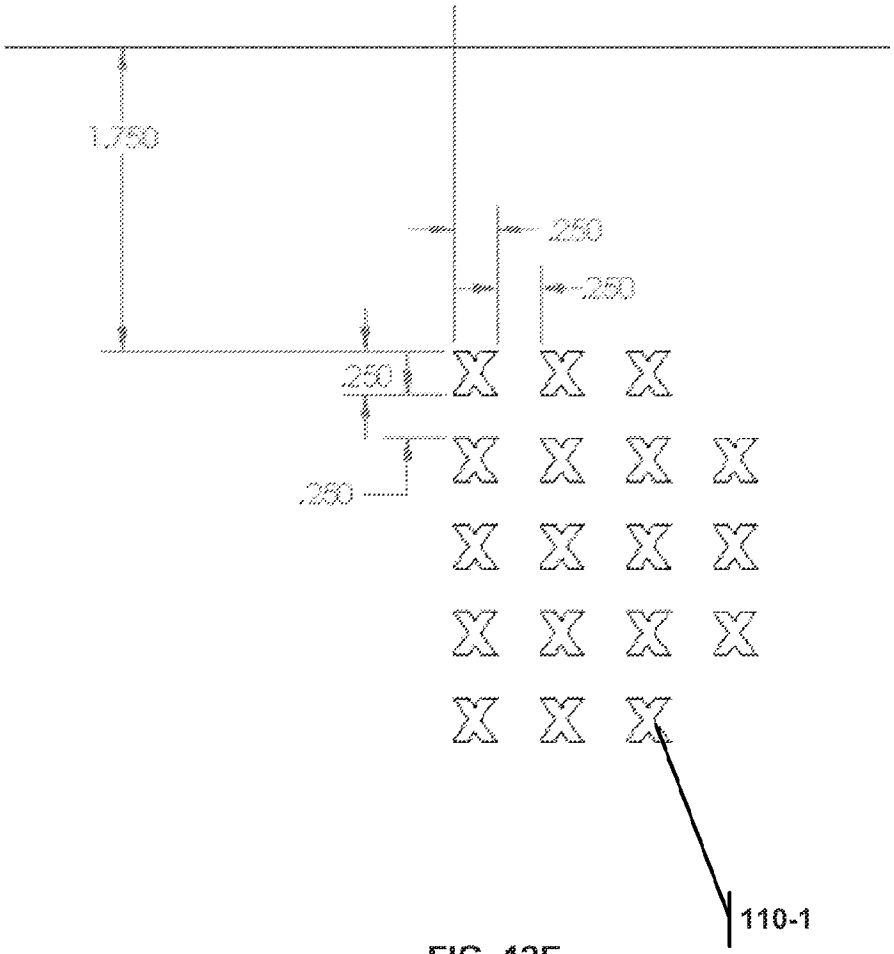
FIG. 12E is an enlargement of an alternate hearing slot design (X-Shaped) showing the dimensions of those slots, which are preferably 0.250" and spaced 0.250" apart.

Finally, the seventh embodiment face shield body 105 is shown in FIGS. 12A-12F. An isometric view of the face shield body 105 is provided in FIG. 12A, and illustrates two anchors/barbs 7 on either side of the body, wherein the anchors/barbs 7 are within the face shield body frame 115 (FIG. 12C). This embodiment wraps around the user's ears, and provides hearing slots 110 that may correspond with the user's ear location when the face shield is worn. FIG. 12D is an enlargement of the hearing slots 110 from FIG. 12B, showing the dimensions of those slots, which are preferably approximately 0.250" each dimension, and spaced approximately 0.250" apart. The slot size, number, shape and placement should be dimensions that do not affect the structural integrity of the face shield body. If the slots are too large or are grouped too closely together, the tension imparted by the elastic strap will cause the face shield to warp at the hearing slot location, affecting the integrity of the face shield and its efficacy. In FIGS. 12A-12D the hearing slots 110 illustrated are shown as squares, and in FIGS. 12E-12F the hearing slots 110-1 are shown as X-shaped. The hearings slots are positioned adjacent to the user's ears when the face shield is worn.

Figure 12F:
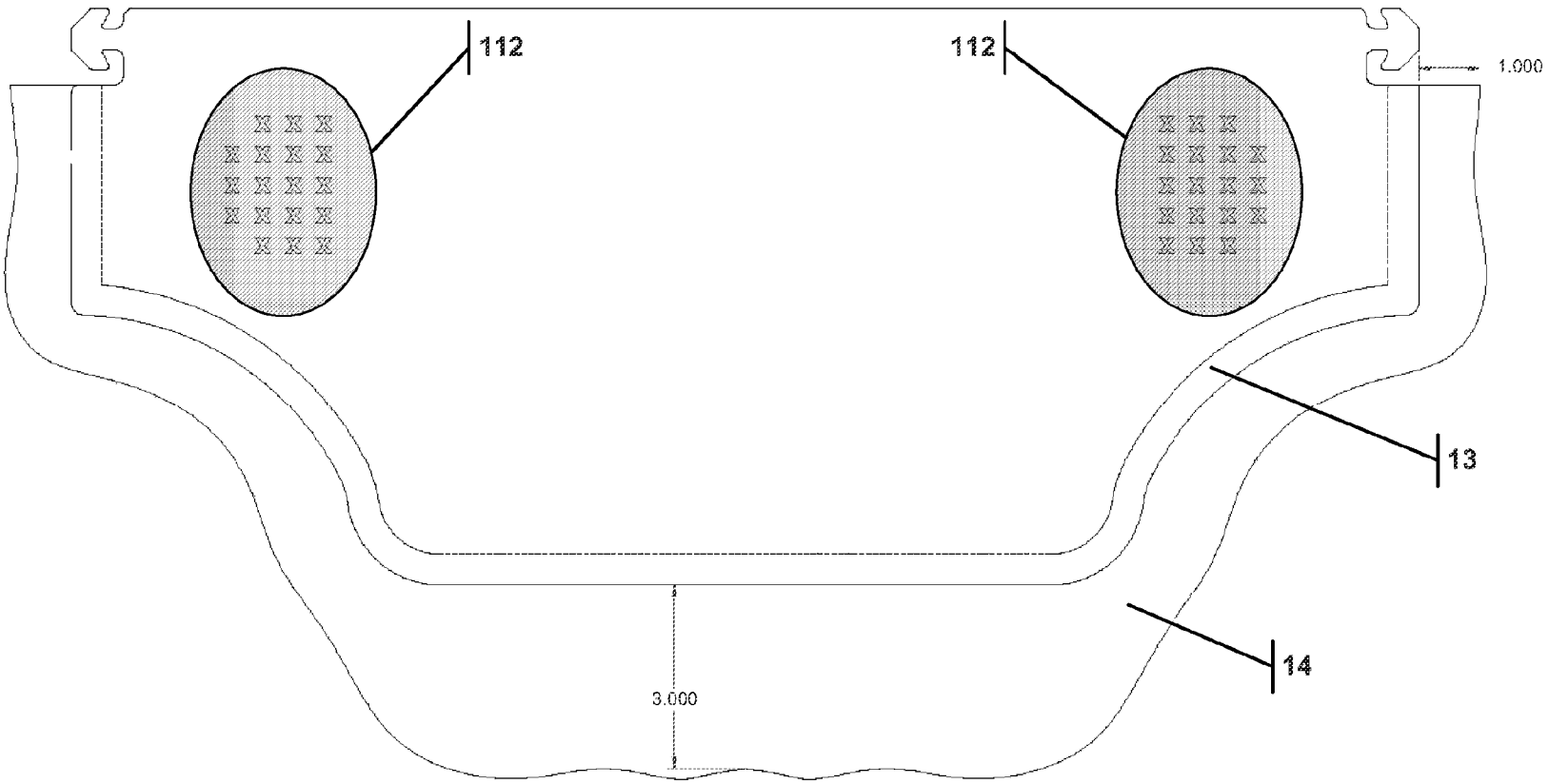
FIG. 12F is a plan view of the seventh embodiment of the face shield body having a cloth-like edge material (with preferred dimensions shown) adhered to the edge of the face shield body, similar to that shown in FIG. 4D.

The wrap around design provides additional protection to the user because it covers the back and side areas of the user's head, in contrast to a standard face shield, where the aerosol from a cough or sneeze may enter from the back and sides. Adding the cloth-like edge material discussed above to the wrap around design, as shown in FIG. 12F (i.e., extending laterally from the side edges and the bottom edge), adds even further protection from aerosols entering the face shield perimeter. The same cloth-like material can be added as a covering 112 over the hearing slots, which protects against aerosols from entering the face shield through the hearing slots. Also, FIG. 12F provides the dimensions of the lateral extension from the side and bottom edges, and the amount of extension may not be uniform.

While each of the described embodiments illustrates that the anchor/barbs are located on the edge near the top edge, it is also possible to include a top edge extension that would help protect the top of the user's head. This is shown in FIG. 13, where a top edge extension 120 extends from the original top edge 125 (as illustrated in the previously described embodiments, also the line defined by the two anchor/barbs 24). The top edge extension 120 would act as a shield to protect the user's hair from being exposed. The anchor/barbs 7, spacer and other features previously described may be used with this embodiment. The spacer (not shown) would preferably be located along the original top edge 125 (or line 24).

There are many obvious shape variations on the hearing slots that would be obvious to one of skill in the art, that may be alternatively implemented without departing from the scope and spirit of this invention. The hearing slots are an improvement upon prior art so that the user, such as a medical worker, can hear sounds and communication unobstructed through the hearing slots 110 in any occupational setting. The element of the hearing slots may be used in conjunction with any of the previous embodiments.

As described above, the face shield body has at least two configurations: (1) an unworn configuration, wherein the transparent surface is planar as shown and supported in FIGS. 1, 2, 3A, 4A, 4C, 4D, 5A, 6A, 7A, 7B, 9A, 10A, 10B, 12A, 12B, 12F and 13; and (2) a worn configuration, wherein the user wears the face shield and the elastic strap is in a stretched configuration and pulls on the first and second anchor/barbs, causing the transparent surface to curve into a non-planar surface, as shown and supported in FIGS. 8A through 8D.

The features of the magnification region, material of the transparent surface and the spacer, and the cloth-like edge material and edge adhesive discussed in previous paragraphs, as well as variations upon the features discussed as would be apparent to one skilled in the art, may also be used with this embodiment.

The invention has been described in connection with specific embodiments that illustrate examples of the invention but do not limit its scope. Various example systems have been shown and described having various aspects and elements. Unless indicated otherwise, any feature, aspect or element of any of these systems may be removed from, added to, combined with or modified by any other feature, aspect or element of any of the systems. As will be apparent to persons skilled in the art, modifications and adaptations to the above-described systems and methods can be made without departing from the spirit and scope of the invention, which is defined only by the following claims. Moreover, the applicant expressly does not intend that the following claims "and the embodiments in the specification to be strictly coextensive." *Phillips v. AHW Corp.,* 415 F.3d 1303, 1323 (Fed. Cir. 2005) (en banc).

The invention claimed is:

1. A face shield for covering the eyes, nose and mouth of a user, the face shield comprising:

a face shield body comprising a transparent surface having a first side edge, a second side edge, a bottom edge, and a top edge, wherein the first side edge comprises a first anchor/barb, the second side edge comprises a second anchor/barb, and wherein the first and second anchor/barbs define a line;

wherein the transparent surface is configured to cover the user's ear and comprises a plurality of hearing slots adapted to be positioned adjacent to the user's ears;

a spacer attached at or near the line, and extending away from the face shield body;

an elastic strap with a first slot and a second slot, the first slot configured to receive the first anchor/barb, and the second slot configured to receive the second anchor/barb;

wherein the face shield body has at least two configurations:

an unworn configuration, wherein the transparent surface is planar; and a worn configuration, wherein the user wears the face shield, and the elastic strap is in a stretched configuration and pulls on the first and second anchor/barbs, causing the transparent surface to curve into a non-planar surface, and when in the stretched configuration the first slot is detachably affixed to the first anchor/barb, and the second slot is detachably affixed to the second anchor/barb;

an edge material attached to and extending laterally away from the first and second side edges and extending vertically away from the bottom edge of the transparent surface:

wherein the edge material extends from the bottom edge and side edges non-uniformly; and wherein the edge material is an absorbent wicking material.

2. The face shield of claim 1, wherein the first anchor/barb comprises a necked region and a flared region, wherein in the stretched configuration:

the first slot surrounds the necked region and abuts the flared region, and the flared region prevents the first slot from fully detaching from the first anchor/barb.

3. The face shield of claim 1, wherein the transparent surface is comprised of an anti-fog material and/or an anti-viral material.

4. The face shield of claim 1, wherein the transparent surface is tinted to block ultraviolet (UV) light rays.

5. The face shield of claim 1, wherein the edge material is electrostatically charged.

6. The face shield of claim 1, wherein the edge material is a polyester blend.

7. The face shield of claim 1, wherein the edge material is attached to the first and second side edges by adhesive, fastener, stitching and/or thermal welding.

8. The face shield of claim 1, wherein the spacer is comprised of compressible foam material.

9. The face shield of claim 1, wherein the edge material extends laterally from the bottom edge farther than from either side edge.

10. A face shield for covering the eyes, nose and mouth of a user, the face shield comprising:

a face shield body comprising a transparent surface having a first side edge, a second side edge, a bottom edge, and a top edge, wherein the first side edge comprises a first anchor/barb, the second side edge comprises a second anchor/barb, wherein the first and second anchor/barbs define a line;

a spacer attached at or near the line, and extending away from the face shield body; and an elastic strap with a first slot and a second slot, the first slot configured to receive the first anchor/barb, and the second slot configured to receive the second anchor/barb;

wherein the face shield body has at least two configurations:

an unworn configuration, wherein the transparent surface is planar; and a worn configuration, wherein the user wears the face shield, and the elastic strap is in a stretched configuration and pulls on the first and second anchor/barbs, causing the transparent surface to curve into a non-planar surface, and when in the stretched configuration the first slot is detachably affixed to the first anchor/barb, and the second slot is detachably affixed to the second anchor/barb;

an edge material attached to and extending laterally away from the first and second side edges and extending vertically away from the bottom edge of the transparent surface:

wherein the edge material extends from the bottom edge and side edges non-uniformly;

wherein the edge material is an absorbent wicking material; and wherein the transparent surface comprises a magnification region.

11. The face shield of claim 10, wherein when the user wears the face shield, the transparent surface is curved, and the magnification area comprises a plurality of magnification areas based on the curve of the transparent surface.

12. A face shield for covering the eyes, nose and mouth of a user, the face shield comprising:

a face shield body comprising a transparent surface having a first side edge, a second side edge, a bottom edge, and a top edge, wherein the first side edge comprises a first anchor/barb, the second side edge comprises a second anchor/barb, and wherein the first and second anchor/barbs define a line;

wherein the transparent surface is configured to cover the user's ear and comprises a plurality of hearing slots adapted to be positioned adjacent to the user's ears;

a spacer attached at or near the line, and extending away from the face shield body;

an elastic strap with a first slot and a second slot, the first slot configured to receive the first anchor/barb, and the second slot configured to receive the second anchor/barb; and an edge material attached to and extending laterally away from the first and second side edges and extending vertically away from the bottom edge of the transparent surface wherein the edge material extends from the bottom edge and side edges non-uniformly; and wherein the edge material is an absorbent wicking material.

* * * * *